US008962544B2

(12) United States Patent
Johnson et al.

(10) Patent No.: US 8,962,544 B2
(45) **Date of Patent: *Feb. 24, 2015**

(54) DETERGENT COMPOSITION FOR REMOVING FISH SOIL

(75) Inventors: Jenna M. Johnson, Minneapolis, MN (US); Victor F. Man, St. Paul, MN (US); Kim R. Smith, Woodbury, MN (US); Tomoko Nakabayashi, Saitama (JP)

(73) Assignee: Ecolab USA Inc., St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/482,416

(22) Filed: May 29, 2012

(65) Prior Publication Data

US 2013/0239995 A1 Sep. 19, 2013

Related U.S. Application Data

(63) Continuation-in-part of application No. 12/841,840, filed on Jul. 22, 2010, now abandoned, which is a continuation-in-part of application No. 11/675,415, filed on Feb. 15, 2007, now Pat. No. 8,093,200.

(60) Provisional application No. 61/236,617, filed on Aug. 25, 2009.

(51) Int. Cl.

| | |
|---|---|
| ***C11D 17/00*** | (2006.01) |
| ***C11D 3/10*** | (2006.01) |
| ***C11D 3/20*** | (2006.01) |
| ***B08B 3/08*** | (2006.01) |
| ***B08B 9/20*** | (2006.01) |
| ***C11D 3/04*** | (2006.01) |
| ***C11D 7/10*** | (2006.01) |
| ***C11D 7/12*** | (2006.01) |
| ***C11D 9/10*** | (2006.01) |
| ***C11D 9/12*** | (2006.01) |
| ***C11D 10/04*** | (2006.01) |
| ***C11D 13/18*** | (2006.01) |
| ***C11D 1/04*** | (2006.01) |
| ***C11D 1/72*** | (2006.01) |
| ***C11D 3/37*** | (2006.01) |
| ***C11D 7/26*** | (2006.01) |
| ***C11D 9/26*** | (2006.01) |

(52) U.S. Cl.

CPC ..... *C11D 3/2079* (2013.01); *C11D 3/10* (2013.01); *C11D 3/046* (2013.01); *B08B 3/08* (2013.01); *C11D 7/10* (2013.01); *C11D 7/12* (2013.01); *C11D 9/10* (2013.01); *C11D 9/12* (2013.01); *C11D 10/045* (2013.01); *C11D 13/18* (2013.01); *C11D 1/04* (2013.01); *C11D 1/72* (2013.01); *C11D 3/2086* (2013.01); *C11D 3/3761* (2013.01); *C11D 7/265* (2013.01); *C11D 9/26* (2013.01)

USPC ..... 510/445; 510/446; 510/108; 510/224; 510/294; 510/298; 510/353; 510/356; 510/451; 510/477; 510/491; 510/509; 134/25.2

(58) Field of Classification Search

USPC ..... 510/445, 446, 108, 224, 294, 298, 353, 510/356, 451, 477, 491, 509; 134/25.2

See application file for complete search history.

(56) References Cited

U.S. PATENT DOCUMENTS

| | | | | |
|---|---|---|---|---|
| 5,559,089 | A * | 9/1996 | Hartman et al. | 510/224 |
| 6,150,324 | A * | 11/2000 | Lentsch et al. | 510/446 |
| 6,228,825 | B1 * | 5/2001 | Gorlin et al. | 510/226 |
| 8,093,200 | B2 * | 1/2012 | Bartelme et al. | 510/445 |
| 8,309,509 | B2 * | 11/2012 | Bartelme et al. | 510/445 |
| 8,697,625 | B2 * | 4/2014 | Bartelme et al. | 510/445 |
| 2003/0040458 | A1 * | 2/2003 | Olson et al. | 510/446 |
| 2004/0171512 | A1 * | 9/2004 | Furuta et al. | 510/470 |
| 2008/0280806 | A1 * | 11/2008 | Bartelme et al. | 510/446 |
| 2010/0105598 | A1 * | 4/2010 | Augustinus et al. | 510/226 |

* cited by examiner

*Primary Examiner* — Lorna M Douyon

(74) *Attorney, Agent, or Firm* — Amy J. Hoffman

(57) ABSTRACT

A detergent composition as described which can be utilized in a variety of applications for cleaning surfaces and objects, removing suspended soils, and rinsing easily. The detergent composition is particularly effective at removing soils caused by raw fish soil.

12 Claims, 3 Drawing Sheets

DETERGENT COMPOSITION FOR REMOVING FISH SOIL

RELATED APPLICATIONS

This application claims priority from U.S. provisional application No. 61/236,617 filed Aug. 25, 2009 the disclosure of which is incorporated herein by reference in its entirety for all purposes. This application is a continuation-in-part of U.S. patent application Ser. No. 12/841,840, filed Jul. 22, 2010, now abandoned, which is a continuation-in-part of U.S. patent application Ser. No. 11/675,415, filed Feb. 15, 2007, now U.S. Pat. No. 8,093,200, entitled, "Fast Dissolving Solid Detergent," the disclosure of which is incorporated herein by reference in its entirety for all purposes.

FIELD OF THE INVENTION

A first aspect of this invention relates to solid or liquid detergent compositions that are particularly useful in home, industrial and institutional warewashing machines. A second aspect of this invention relates to methods for producing the detergent compositions. A third aspect of this invention relates to methods for using the detergent compositions.

BACKGROUND OF THE INVENTION

Solid alkaline detergent compositions are widely used for household and industrial dishwashing, laundering clothing and general surface cleansing. The greater amount of such cleaning compositions consumed consists of solid granules, tablets or pellets and solid blocks. Solid compositions are advantageous for their improved handling and safety, elimination of component segregation during transportation and storage and increased concentration of active components within the composition. These detergent compositions typically incorporate a source of alkalinity such as an alkali metal hydroxide, carbonate, bicarbonate, silicate or mixtures thereof and a hardness sequestering agent or builder as their primary cleaning components. The hardness sequestering agent acts to condition the wash water by chelating or otherwise complexing the metal cations responsible for the precipitation of alkali metal builder salts and detergents. The alkaline components impart detergency to the compositions by breaking down acidic and proteinaceous soils.

Automatic warewashing detergents are well known. Historically, automatic warewashing detergents contain high amounts of caustic component, in particular sodium hydroxide. In recent years, attention has been directed to producing a highly effective detergent material from less caustic materials such as soda ash, also known as sodium carbonate, because of manufacturing, processing, etc. advantages. Consumers have also driven the push to formulate automatic warewashing detergents without caustic components.

Difficulty has ensued when attempting to formulate caustic-free warewashing detergents. This is due to at least one reason. Sodium carbonate is a mild base, and is substantially less strong than sodium hydroxide. Further on an equivalent molar basis, the pH of the sodium carbonate solution is one unit less than an equivalent solution of sodium hydroxide (an order of magnitude reduction in strength of alkalinity). Sodium carbonate formulations were not given serious consideration in the industry for use in heavy duty cleaning operations because of this difference in alkalinity. The industry believed carbonate could not adequately clean under the demanding conditions of time, soil load and type and temperature found in the institutional and industrial cleaning market. A few sodium carbonate based formulations have been manufactured and sold in areas where cleaning efficiency is not paramount.

In recent times, certain industrial markets throughout the world have insisted upon caustic-free or substantially caustic-free warewashing detergents. In particular, customers in Japan have sought caustic-free warewashing detergents. In addition, customers have scrutinized chlorinated products and as a result there has been a movement to eliminate chlorine from warewashing detergents as well. While moving to an ash-based, substantially chlorine free detergent provides a more appealing product line; such a product must also maintain cleaning-ability. While manufacturers strive to meet customer's requests, the effectiveness of the product may be compromised when eliminating the caustic and chlorine components.

For the most part a caustic-free, chlorine-free warewashing detergent has been suitable except for removal of tenacious soils. Again, particularly in Japan where the consumption of fish is generally higher than in the Western markets, soils caused by the oil and protein of fish and generally caused by raw fish is a difficult soil to remove. The inventors have found that such fish soil is very tenacious and often resists removal by substantially caustic-free chlorine-free warewashing detergents. The Japanese customer has complained about the retention of such soil post-automatic warewashing of cooking and eating utensils and implements.

The present invention provides a solid composition that is substantially caustic-free and substantially chlorine free yet is effective at removing tenacious soils such as those caused by raw fish protein and oil. The present invention further provides a liquid detergent suitable for removing soils such as those caused by raw fish protein and oil.

SUMMARY

The invention is directed to substantially caustic and chlorine-free detergent compositions, as for example, ware and/or hard surface cleaning compositions, rinse aids, sanitizing additives, and laundry detergents. Compositions of the invention include a substantially sodium hydroxide free alkaline source sufficient to produce a use solution having a pH of at least 10; an active agent consisting essentially of branched fatty acid, inorganic salt, or alcohol alkoxylate or combinations thereof; builder; solidification agents (in the case of a solid detergent); and additional components such as detergent adjuvants as desired. Compositions of the invention are surprisingly suitable for removing tenacious soils caused by protein and oils, particularly those found in raw fish soils.

A solid detergent composition is disclosed, comprising an alkali metal carbonate as an alkaline source in an effective amount to provide a use solution having a pH of at least about 10; water conditioning agent in an amount of about 1 to 70 wt. %; an active agent consisting essentially of inorganic salt, alcohol alkoxylate, or branched fatty acid salt or combinations thereof; a solidification agent; and wherein the solid detergent composition comprises less than 5 weight percent sodium hydroxide and less than 5 weight percent chlorine. The solid detergent composition may also be substantially free of defoaming agents and additional anionic surfactants apart from the fatty acid active agent.

In another embodiment a solid detergent composition is disclosed, comprising 1 to 30 weight percent alkaline source; 1 to 30 weight percent water conditioning agent; and 0.01 to 10 wt. % active agent selected from the group consisting essentially of inorganic salt, or alcohol alkoxylate, branched fatty acid salt or combinations thereof; wherein the solid detergent composition comprises less than 2 weight percent sodium hydroxide and less than 2 weight percent chlorine.

In another embodiment a solid detergent composition is disclosed, comprising 1 to 30 weight percent alkaline source; 1 to 30 weight percent water conditioning agent; and 0.01 to 10 wt. % active agent selected from the group consisting essentially of inorganic salt, or alcohol alkoxylate, branched fatty acid salt or combinations thereof; wherein the solid detergent composition is substantially free of sodium hydroxide and chlorine.

In an alternate embodiment a liquid detergent composition is disclosed comprising an alkaline source, water conditioning agent and 0.01 to 10 wt. % active agent selected from the group consisting essentially of inorganic salt, or alcohol alkoxylate, branched fatty acid salt or combinations thereof.

A method of removing fish soil is disclosed.

In another embodiment a solid detergent composition is disclosed comprising an alkali metal carbonate as an alkaline source in an amount effective to provide a use solution having a pH of at least about 9.5; water conditioning agent in an amount of about 1 to 70 wt. %; an active agent in an amount of about 2 to 7 wt. % consisting essentially of inorganic potassium salt, alcohol alkoxylate, or a branched fatty acid selected from the group consisting of isopentanoic acid, neopentanoic acid, isohexanioc acid, neohexanioc acid, isoheptanoic acid, neoheptanoic acid, isooctanoic acid, neooctanioc acid, isononanoic acid, neononanoic acid, isodecanoic acid, neodecanoic acid, and salts thereof and mixtures thereof; a solidification agent; wherein the solid detergent composition comprises less than 5 weight percent sodium hydroxide and less than 3 weight percent active chlorine; and wherein the composition is substantially free of defoaming agents and additional anionic surfactants apart from the branched fatty acid active agent.

DETAILED DESCRIPTION OF SOME EMBODIMENTS OF THE INVENTION

Figure 1:
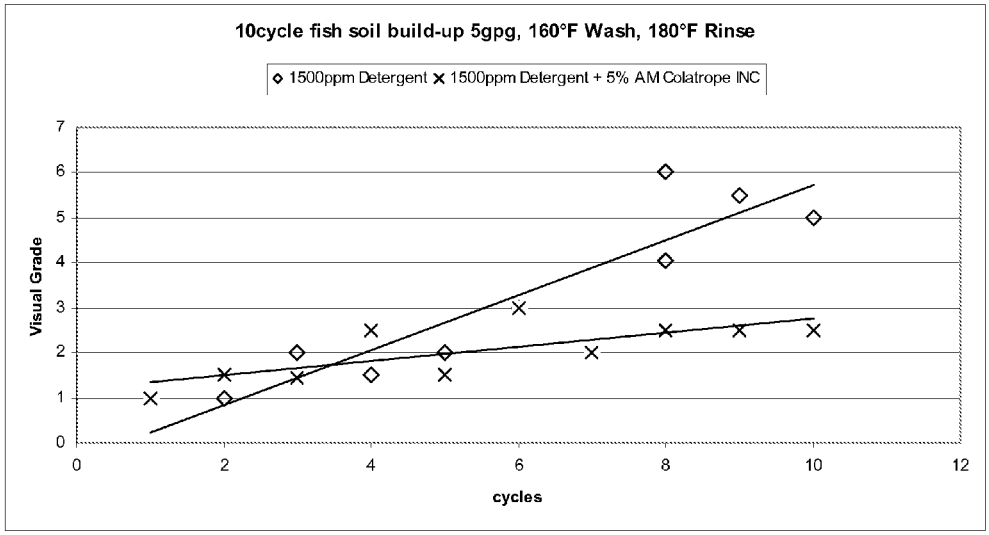
FIG. 1 has an x and y axis. The x-axis is a measure of the number of automatic warewashing cycles run. The y-axis is a measure of the visual grade, an indicator of protein removal with the lowest grade signifying the greatest amount of protein removal. In other words, the lower the visual grade, the cleaner the tile.

A solid or liquid detergent composition is provided that is substantially free of caustic component and substantially free of chlorine yet is effective at removing soils caused by protein and oil. Compositions of the invention are effective at removing soils caused by raw protein and oil, particularly those caused by fish. Compositions of the invention include an effective amount of a caustic-free alkaline source to provide a pH of at least 10 in a use solution; solidification agent for binding the composition (in the case of a solid detergent); an active agent selected from the group consisting essentially of a branched fatty acid, an alcohol alkoxylate, an inorganic salt or combinations thereof to remove tenacious soils; and a builder. The detergent may include any other adjuvant that provides desirable properties such as anti-redeposition agents, defoaming agent, enzymes, processing aid, aesthetic aids such as fragrance or colorant, pH modifier, dispersant, corrosion inhibitors, and the like. The detergent may incorporate sodium hydroxide in an amount of less than 5 weight percent, less than 3 weight percent, or less than 2 weight percent in order to allow for pH adjustment of the final composition.

The following definitions are useful in describing elements of the invention:

"Fish soil" as used herein refers to any residue remaining on a surface after contact with any type of fish rather it is seafood or freshwater derived. "Fish soil" includes but is not limited to proteins such as albumin, glycoproteins, lipoproteins, and fats including lipids and oils.

All numeric values are herein assumed to be modified by the term "about," whether or not explicitly indicated. The term "about" generally refers to a range of numbers that one of skill in the art would consider equivalent to the recited value (i.e., having the same function or result). In many instances, the terms "about" may include numbers that are rounded to the nearest significant figure.

Weight percent, percent by weight, wt %, wt-%, % by weight, and the like are synonyms that refer to the concentration of a substance as the weight of that substance divided by the weight of the composition and multiplied by 100. As used in this application, the term "wt. %" refers to the weight percent of the indicated component relative to the total weight of the detergent composition, unless indicated differently. The weight percentage of an individual component does not include any water supplied with that component, even if the component is supplied as an aqueous solution or in a liquid premix, unless otherwise specified.

Unless otherwise stated, all weight percentages provided herein reflect the weight percentage of the raw material as provided from the manufacturer. The active weight percent of each component is easily determined from the provided information by use of product data sheets as provided from the manufacturer.

The recitation of numerical ranges by endpoints includes all numbers within that range (e.g. 1 to 5 includes 1, 1.5, 2, 2.75, 3, 3.80, 4, and 5).

As used in this specification and the appended claims, the singular forms "a", "an", and "the" include plural referents unless the content clearly dictates otherwise. As used in this specification and the appended claims, the term "or" is generally employed in its sense including "and/or" unless the content clearly dictates otherwise.

The term "surfactant" or "surface active agent" refers to an organic chemical that when added to a liquid changes the properties of that liquid at a surface.

The terms EO, PO, or EO/PO as used herein refer to ethylene oxide and propylene oxide, respectively. EO/PO refers to ethylene oxide and propylene oxide groups.

The term "alkoxy" refers to a straight or branched chain monovalent hydrocarbon radical having a specified number of carbon atoms and a carbon-oxygen-carbon bond, may be unsubstituted or substituted with substituents that do not interfere with the specified function of the composition and may be substituted once or twice with the same or different group. Substituents may include alkoxy, hydroxy, mercapto, amino, alkyl substituted amino, nitro, carboxy, carbanoyl, carbanoyloxy, cyano, methylsulfonylamino, or halo, for example. Examples include methoxy, ethoxy, propoxy, t-butoxy, and the like.

The term "substantially free" may refer to any component that the composition of the invention lacks or mostly lacks. When referring to "substantially free" it is intended that the component is not intentionally added to compositions of the invention. Use of the term "substantially free" of a component allows for trace amounts of that component to be included in compositions of the invention because they are present in another component. However, it is recognized that only trace or de minimus amounts of a component will be allowed when the composition is said to be "substantially free" of that component. Moreover, if a composition is said to be "substantially free" of a component, if the component is present in trace or de minimus amounts it is understood that it will not affect the effectiveness of the composition. It is understood that if an ingredient is not expressly included herein or its possible inclusion is not stated herein, the invention composition may be substantially free of that ingredient. Likewise, the express inclusion of an ingredient allows for its express exclusion thereby allowing a composition to be substantially free of that expressly stated ingredient.

As used herein the term, "consisting essentially of" in reference to a composition refers to the listed ingredients and does not include additional ingredients that, if present, would affect the cleaning ability of the cleaning composition. The term "consisting essentially of" may also refer to a component of the cleaning composition. For instance, a surfactant package may consist essentially of two or more surfactants and such surfactant package would not include any other ingredients that would affect the effectiveness of that surfactant package—either positively or negatively. As used herein the term "consisting essentially of" in reference to a method of cleaning refers to the listed steps and does not include additional steps (or ingredients if a composition is included in the method) that, if present, would affect the cleaning ability of the cleaning method.

A solid detergent composition according to the present disclosure encompasses a variety of cast and extruded forms including, for example, solids, pellets, blocks, and tablets. It should be understood that the term "solid" refers to the state of the detergent composition under the expected conditions of storage and use of the solid detergent composition. In general, it is expected that the detergent composition will remain a solid when provided at a temperature of up to about 100° F. and preferably greater than 120° F.

In certain embodiments, the detergent composition is provided in the form of a unit dose. A unit dose refers to a detergent composition unit sized so that the entire unit is used during a single washing cycle. When the solid detergent composition is provided as a unit dose, it is preferably provided as a cast solid, an extruded pellet, or a tablet having a size of between about 1 gram and about 50 grams. In other embodiments, a cast solid, an extruded pellet, or a tablet having a size of between 50 grams up through 250 grams, or an extruded solid with a weight of about 100 grams or greater. Furthermore, it should be appreciated that the solid detergent composition can be provided as a cast solid, an extruded pellet, or a tablet so that a plurality of the solids will be available in a package having a size of between about 40 grams and about 11,000 grams. A liquid detergent may be provided in a unit dose by providing a single dose of detergent in a sealed water soluble polymer container.

In other embodiments, the solid detergent composition is provided in the form of a multiple-use solid, such as, a block or a plurality of pellets, and can be repeatedly used to generate aqueous detergent compositions for multiple washing cycles. In certain embodiments, the solid detergent composition is provided as a powder, cast solid, an extruded block, or a tablet having a mass of between about 5 grams and 10 kilograms, or between about 0.01 and 22 pounds. In certain embodiments, a multiple-use form of the solid detergent composition has a mass between about 1 and 10 kilograms, or between about 0.002 and 22 pounds. In further embodiments, a multiple-use form of the solid detergent composition has a mass of between about 5 kilograms and about 8 kilograms, or between about 11 and 17.6 pounds. In other embodiments, a multiple-use form of the solid detergent composition has a mass of between about 5 grams and about 1 kilogram, or between about 5 grams and about 500 grams, or between about 0.01 and 1.1 pound.

In yet other embodiments, the detergent composition is provided as a liquid. Such a liquid may be in the form of a liquid concentrate or a liquid use solution may be prepared either by diluting a solid concentrate or a liquid concentrate with water.

Active Agent

An active agent is a component of the composition of the invention. The active agent may be selected from the group consisting essentially of branched fatty acid salt, inorganic salt, and alcohol alkoxylate or combinations thereof. An active agent as used herein is defined as an additive to a detergent product that improves the removal of tenacious soils such as raw proteins and oils, particularly those originating from fish. Each of the active agents useful in formulating compositions of the invention is described in more detail below. The skilled artisan will understand that each of the active agents may be used alone or in combination with other active agents to formulate compositions of the invention.

Branched Fatty Acid Salt

A first active agent that is useful in formulating compositions of the invention is selected from the group of branched fatty acid salts. The detergent composition of the present invention may include a branched fatty acid salt as the active agent. Without being bound by theory, the branched fatty acid salt may enhance the cleaning ability of the product by lowering the surface tension of the aqueous use solution to allow better penetration of the use solution into the soil and act as a hydrotrope to stabilize the detergent composition and the use solution.

Branched fatty acid salts useful as the active agent in the present invention include $C_8$ to $C_{20}$ branched fatty acids and salts thereof. Representative branched structures can be described as iso-, neo-, sec- or tert-. In many embodiments, the branched fatty acid salts are saturated $C_8$ to $C_{20}$ fatty acids which include one or more alkyl branches off the main alkyl chain. In certain embodiments, the branched fatty acids are saturated $C_8$ to $C_{20}$ fatty acids which include one or two methyl branches off the main alkyl chain. In other embodiments, $C_8$ to $C_{12}$ fatty acids which include one or two methyl branches off the main alkyl chain are preferred. In certain embodiments, the branched fatty acids are represented by the formula $CH_3(CH_2)_m(CR1R2)_n(CH_2)_o(CR1R2)_p(CH_2)_q$ COOH wherein m, n, o, p and q are each an integer selected from 0-17, and n+p is 1 or 2, and m+n+o+p+q is between 6 and 18 where $R_1$, $R_2$ can be independently a hydrogen or alkyl group with at least one being an alkyl group and the alkyl group is preferably a methyl group. In some embodiments, the branched fatty acids are salts of branched fatty acids of the above formula. In certain embodiments, $CH_3(CH_2)_m(CR1R2)_n(CH_2)_o(CR1R2)_p(CH_2)_q$ COOH wherein m, n, o, p and q are each an integer selected from 0-17, and n+p is 1 or 2, and m+n+o+p+q is between 6 and 12 where $R_1$, $R_2$ can be independently a hydrogen or alkyl group with at least one being an alkyl group and the alkyl group is preferably a methyl group. Examples of suitable branched fatty acids are sodium isononanoate, isononanoic acid, sodium isooctanoate, isooctanoic acid, sodium neodecanoate, neodecanoic acid, sodium neopentanoate, neopentanoic acid, sodium neoheptanoate, neoheptanoic acid, any of the acids shown below and salts thereof, or mixtures thereof.

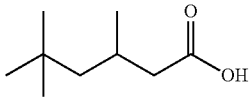

3,5,5-trimethylhexanoic acid

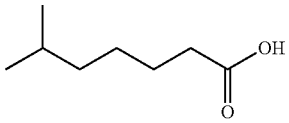

6-methyl-heptanoic acid

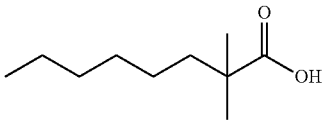

2,2-dimethyloctanoic acid

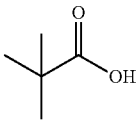

neopentanoic acid
(2,2-dimethylpropanoic acid)

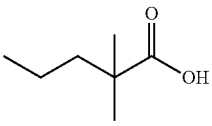

2,2-dimethylpentanoic acid

In an embodiment the branched fatty acid is a water soluble salt, including but not limited to a sodium, potassium, or lithium salt. The branched fatty acid may be soap based, and includes but is not limited to isononanoate, iso $C_9$ alkanoate, and 3, 5, 5 trimethyl hexanoic acid salt.

One skilled in the art will recognize that such branched fatty acids and the salts thereof may be categorized as anionic surfactants. In an embodiment, apart from the branched fatty acid and/or the salts thereof, the composition of the invention does not include additional anionic surfactants. That is, the composition is free or substantially free of additional anionic surfactants apart from the branched fatty acid or the salts thereof.

The detergent composition in the present invention includes at least 0.2 weight % of branched fatty acid. In certain embodiments, the detergent composition includes between 0.2 wt. %-5 wt. % of branched fatty acid. In other embodiments, the detergent composition includes between 0.2 wt %-20 wt. % of branched fatty acid. Greater amounts of branched fatty acid, for example >5 wt. % are useful in detergent compositions where the branched fatty acid also functions as a hydrotrope, surfactant and/or detersive component.

Extrudable, ash based solid compositions containing an active agent according to the invention, which are especially suitable to be used in Japan to remove fish soil are provided in the table below:

| Component | % by Weight | | |
|---|---|---|---|
| Sodium carbonate | 0.1-70 | 5-60 | 20-55 |
| Nitriloacetic Acid monohydrate | 0-40 | 10-40 | 15-30 |
| Sodium Polyacrylate | 0-20 | .1-10 | 1-5 |
| Calcium Chloride Dihydrate | 0-5 | .1-3 | 1-2 |
| Sodium bicarbonate | 0-5 | .1-4 | 2-3 |
| Sodium Metasilicate | 0-5 | .1-4 | 2-3 |
| Sodium Aluminate | 0-2 | .1-1 | .1-.5 |
| Pentasodium DTPA | 0-20 | 1-15 | 10-15 |
| Citric Acid | 0-20 | 1-10 | 2-5 |

-continued

| Component | % by Weight | | |
|---|---|---|---|
| Sodium Aluminate, 45% | 0-5 | .1-4 | 1-3 |
| Lauryl Alcohol ethoxylate propoxylated* | 0-6 | 1-6 | 3-5 |
| Ethoxy-propoxy copolymer | 0-10 | .1-5 | 1-3 |
| Active Agent** | 0.1-15 | 1-10 | 2-7 |

*$C_{12}$—$O(EO)_3(PO)_6$ for example
**Alcohol alkoxylate, branched fatty acid salt, inorganic potassium salt, or combinations thereof A liquid ash based liquid composition containing an active agent according to the invention, that is especially suitable to be used in Japan to remove soil is provided in the table below:

| Component | % by Weight |
|---|---|
| Water - Zeolite softened | 40-80 |
| Nitriloacetic acid | 10-30 |
| Potassium EDTA | 0.1-5 |
| Sodium Carbonate | 1-10 |
| Potassium Carbonate | 5-20 |
| Active Agent** | 0.1-15 |

**Alcohol alkoxylate, branched fatty acid salt, inorganic potassium salt, or combinations thereof Alcohol Alkoxylate A second active agent that may be used alone or in combination with other active agents are alcohol alkoxylates. It was surprisingly found that alcohol alkoxylates provide enhanced ability to remove tenacious soils caused by protein and oil, particularly those originating from fish. Without being bound by theory, it is hypothesized that the alcohol alkoxylate acts as a soil penetrant to allow the detergent to access the surface of the ware. If the alcohol alkoxylate is the active agent included in compositions of the invention it is preferably linear with a single branch and chlorine stable. An example of such an alcohol alkoxylate includes but is not limited to Plurafac® LF901 surfactant available from BASF. A desirable alcohol alkoxylate is 2-propyl heptanol having an EO/PO ratio of about 16/11.

Another example of a suitable sodium isononanoate useful as the active agent in formulating compositions of the invention are those available under the tradename Cola®Trope INC and Cola®Trope INC-K both available from Colonial Chemical, Inc. located in Marion County, Tennessee, United States.

In an embodiment of the invention compositions of the invention include between about 0.1 and 30 weight percent alcohol alkoxylate, between about 0.5 and 15 weight percent, and between about 0.75 and 5 weight percent. In another embodiment, the composition comprises between about 0.1 to about 10 weight percent, between about 0.25 and about 8 weight percent, and between about 0.5 and 5 weight percent alcohol alkoxylate as the active agent.

Inorganic Potassium Salt

A third active agent that may be used alone or in combination with other active agents are inorganic potassium salts. It was surprisingly found that inorganic salts when used in caustic-free and chlorine-free warewashing detergents assist in solubilizing proteins and oils. Examples of inorganic salts useful as active agents in compositions of the present invention include but are not limited to potassium carbonate, potassium nitrate, potassium sulfate, and potassium sesquicarbonate.

Alkaline Sources

The detergent composition according to the invention includes an effective amount of one or more alkaline sources to enhance cleaning of a substrate along with the active agent and improve soil removal performance of the composition. In general, an effective amount of one or more alkaline sources should be considered as an amount that provides a use composition having a pH of at least about 9.5. When the use composition has a pH of between about 9.5 and about 11, it can be considered mildly alkaline. In general, it is desirable to provide the use composition as a mildly alkaline cleaning composition because it is considered safer than the caustic based use compositions.

The detergent composition can include an alkali metal carbonate as the alkaline source. Exemplary metal carbonates that can be used include, for example, sodium or potassium carbonate, bicarbonate, sesquicarbonate, and mixtures thereof. The detergent composition can include a sufficient amount of the alkaline source to provide the use composition with a pH of at least about 8, or at least about 9, 9.5 or at least about 10. The source of alkalinity is preferably in an amount to enhance the cleaning of a substrate and improve soil removal performance of the composition. In general, it is expected that the concentrate will include the alkaline source in an amount of at least about 5 wt. %, at least about 10 wt. %, at least about 15 wt. %, at least about 20 wt. %, at least about 25 wt. %, and at least about 30 wt. %. The detergent composition can include between about 10 wt. % and about 80 wt. %, preferably between about 15 wt. % and about 70 wt. %, between about 20 wt. % and about 60 wt, or more preferably between about 30 and 60 wt. % of the source of alkalinity. The source of alkalinity can additionally be provided in an amount to neutralize any anionic surfactant and may be used to assist in the solidification of the composition.

In order to provide sufficient room for other components in the concentrate, the alkaline source can be provided in the concentrate in an amount of less than about 60 wt. %. In addition, the alkaline source can be provided at a level of less than about 40 wt. %, less than about 30 wt. %, or less than about 20 wt. %. In certain embodiments, it is expected that the detergent composition may provide a use composition that is useful at pH levels above about 8, above about 9, or above about 10. Additional pH adjusting agents may be used to provide the use composition with the desired pH.

In some embodiments, the solidification agent is inorganic in nature and optionally may also act as a source of alkalinity. In certain embodiments, the solidification agent includes sodium carbonate or ash, and sodium metasilicate, or combinations thereof.

Water Conditioning Agent

The water conditioning agent can be referred to as a detergent builder and/or chelating agent and generally provides cleaning properties and chelating properties. Exemplary detergent builders include sodium sulphate, starch, sugars, $C_1$ $C_{10}$ alkylene glycols such as propylene glycol, and the like. Exemplary chelating agents include phosphates, phosphonates, and amino-carboxylates. Exemplary phosphates include sodium orthophosphate, potassium orthophosphate, sodium pyrophosphate, potassium pyrophosphate, sodium tripolyphosphate (STPP), and sodium hexametaphosphate. Exemplary phosphonates include 1-hydroxyethane-1,1-diphosphonic acid, aminotrimethylene phosphonic acid, diethylenetriaminepenta(methylenephosphonic acid), 1-hydroxyethane-1,1-diphosphonic acid $CH_3C(OH)[PO(OH)_2]_2$, aminotri(methylenephosphonic acid) $N[CH_2PO(OH)_2]_3$, aminotri(methylenephosphonate), 2-hydroxyethyliminobis (methylenephosphonic acid) $HOCH_2CH_2N[CH_2PO(OH)_2]_2$, diethylenetriamine penta(methylenephosphonic acid) $(HO)_2POCH_2N[CH_2CH_2N[CH_2PO(OH)_2]_2]_{-2}$, diethylenetriaminepenta(methylenephosphonate), sodium salt $C_9H_{(28-x)}N_3Na_xO_{15}P_5$ (x=7), hexamethylenediamine(tetramethylenephosphonate), potassium salt $C_{10}H_{(28-x)}N_2K_xO_{12}P_4$ (x=6), bis(hexamethylene)triamine(pentamethylenephosphonic acid) $(HO_2)POCH_2N[(CH_2)_6N[CH_2PO(OH)_2]_2]_{-2}$, and phosphorus acid $H_3PO_3$. Exemplary amino-carboxylates include aminocarboxylic acids such as N-hydroxyethylimino diacetic acid, nitrilotriacetic acid (NTA), ethylenediaminetetraacetic acid (EDTA), N-hydroxyethyl-ethylenediaminetriacetic acid (DTPA).

Preferably, the water conditioning agent, when it is used, is provided in an amount of between about 1 wt. % of about 50 wt. %, and preferably between about 3 wt. % and 35 wt. %.

Solidification Agent

A solidification agent is useful in the preparing solid compositions of the invention. A solidification agent is preferably dispersed throughout the solid detergent composition to bind the detergent composition together to provide a solid detergent composition. Solidification agents may also be called solidification agents and encompass hardening agents, such as PEG. The binding agent according to the invention can be used as the primary binding agent or as a secondary binding agent of the solid detergent forming composition. The term "primary binding agent" refers to the binding agent that is the primary source for causing the solidification of the detergent composition. The term "secondary binding agent" refers to the binding agent that acts as an auxiliary binding agent in combination with another primary binding agent. The secondary binding agent can be used to enhance solidification of the detergent composition and/or help accelerate the solidification of the detergent composition. Using the binding agent component of the invention as a secondary binding agent component is useful when the primary binding agent component does not solidify the detergent composition at a desired rate. Accordingly, the secondary binding agent component can be used to help accelerate the solidification process.

The solid detergent composition is preferably prepared by providing a composition containing between about 10 wt. % and about 80 wt. % binding agent, or between about 1 wt. % and about 40 wt. % binding agent, and sufficient water to provide necessary hydration for solidification. In certain embodiments, the binding agent may also serve as an alkaline source.

The following patents disclose various combinations of solidification, binding and/or hardening agents and methods for solidification that may be utilized in the solid detergent compositions of the present invention. The following U.S. patents are incorporated herein by reference for all purposes: U.S. Pat. Nos. 7,153,820; 7,094,746; 7,087,569; 7,037,886; 6,831,054; 6,730,653; 6,660,707; 6,653,266; 6,583,094; 6,410,495; 6,258,765; 6,177,392; 6,156,715; 5,858,299; 5,316,688; 5,234,615; 5,198,198; 5,078,301; 4,595,520; 4,680,134; RE32,763; and RE32818.

In certain embodiments, a solid detergent composition includes about 10 to 80 wt % of sodium carbonate ($Na_2CO_3$), or sodium metasilicate, or combinations thereof, for solidification of the solid composition. The solid detergent composition may also include an effective amount of an organic phosphonate hardness sequestering agent comprising a potassium salt. In certain embodiments, a solid detergent composition includes about 10 to 40 wt % of sodium carbonate, in further embodiments 20 to 40 wt % sodium carbonate.

In some embodiments, the binding agent is formed by mixing alkali metal carbonate, alkali metal bicarbonate, and water. In certain embodiments alkali metal carbonate includes soda ash or sodium carbonate. In certain embodiments, the alkali metal bicarbonate includes sodium bicarbonate. The alkali metal bicarbonate component can be provided by adding alkali metal bicarbonate or by forming alkali metal bicarbonate in situ. The alkali metal bicarbonate can be formed in situ by reacting the alkali metal carbonate with an acid. The amounts of alkali metal carbonate, alkali metal bicarbonate, and water can be adjusted to control the rate of solidification of the detergent composition and to control the pH of aqueous detergent composition obtained from the solid detergent composition. The rate of solidification of the detergent composition can be increased by increasing the ratio of alkali metal bicarbonate to alkali metal carbonate, or decreased by decreasing the ratio of alkali metal bicarbonate to alkali metal carbonate.

In certain embodiments, the solid detergent composition contains between about 10 wt. % and about 80 wt. % alkali metal carbonate, between about 1 wt. % and about 40 wt. % alkali metal bicarbonate, and sufficient water to provide at least a monohydrate of carbonate and a monohydrate of bicarbonate.

In other embodiments, solidification agent of the solid detergent composition includes alkaline carbonate, water and a sequestering agent. For example, the compositon includes an alkali metal salt of an organophosphonate at 1-30 wt %, preferably 3-15 wt % of a potassium salt; and water at 5-15 wt %, preferably 5 12 wt %; and Alkali Metal carbonate 25 80 wt %; preferably 30 55 wt %. A single E-form hydrate binder composition forms as this material solidifies. The solid detergent comprises a major proportion of carbonate monohydrate, a portion of non-hydrated (substantially anhydrous) alkali metal carbonate and the E-form binder composition comprising a fraction of the carbonate material, an amount of the organophosphonate and water of hydration.

In yet other embodiments, the solidification agent includes an effective amount of one or more anhydrous salts, which are selected to hydrate and melt at a temperature below that at which significant phosphate reversion occurs. Such temperatures typically fall within the range of about 33°-65° C., preferably salts which melt at about 35°-50° C. will be used. The dispersed, hydrated salt solidifies when the emulsion is cooled and can bind sufficient free water to afford a stable, homogeneous solid at ambient temperatures, e.g., at about 15°-25° C. Preferably an amount of anhydrous sodium carbonate, anhydrous sodium sulfate or mixtures thereof effective to solidify the composition when they are cooled to ambient temperatures will be employed. The amount of solidifying agent is related to the percentage of water present in the composition as well as the hydration capacity of the other detergent components. For example, prior to solidification, preferred liquid detergent emulsions will comprise about 45 to 75% solids, most preferably about 55 to 70% solids and about 25 to 55%, most preferably about 30-45% water.

Water

Water may be a component of both the solid and liquid compositions of the invention.

A solid detergent composition can include water. Water may be independently added to the detergent composition or may be provided in the detergent composition as a result of its presence in an aqueous material that is added to the detergent composition. For example, many of the materials added to the detergent composition include water available for reaction with the solidification agent component(s). Typically, water is introduced into the detergent composition to provide the detergent composition with a desired viscosity prior to solidification, and to provide a desired rate of solidification.

In general, it is expected that water is present as a processing aid and may be removed or become water of hydration. It is expected that water may be present in the solid composition. In certain embodiments of solid detergent composition, water may be present in ranges of between about 0 wt. % to about 10 wt. %, about 0.1 wt. % to about 10 wt. %, about 1 wt. % to about 5 wt. %, and about 2 wt. % to about 3 wt. %. In other embodiments of solid detergent compositions, it is expected that the water will be present in the ranges of between about 25 wt. % to about 40 wt. %, about 27 wt. % to about 35 wt. %, and 29 wt. % to about 31 wt. %. It should be additionally appreciated that the water may be provided as deionized water or as softened water.

The components used to form the solid composition can include water as hydrates or hydrated forms of the binding agent, hydrates or hydrated forms of any of the other ingredients, and/or added aqueous medium as an aid in processing. It is expected that the aqueous medium will help provide the components with a desired viscosity for processing. In addition, it is expected that the aqueous medium may help in the solidification process when is desired to form the concentrate as a solid. When the concentrate is provided as a solid, it can be provided in the form of a block or pellet. It is expected that blocks will have a size of at least about 5 grams, and can include a size of greater than about 50 grams. It is expected that the concentrate will include water in an amount of between about 1 wt. % and about 50 wt. %, and between about 2 wt. % and about 40 wt. %.

When the components that are processed to form the concentrate are processed into a block, it is expected that the components can be processed by extrusion techniques. In general, when the components are processed by extrusion techniques, it is believed that the composition can include a relatively smaller amount of water as an aid for processing compared with the casting techniques. In general, when preparing the solid by extrusion, it is expected that the composition can contain between about 2 wt. % and about 10 wt. % water.

Organic Detergents, Surfactants or Cleaning Agents

The composition can include at least one cleaning agent that is preferably a surfactant or surfactant system. The term "surfactant system" refers to a mixture of at least two surfactants. A variety of surfactants can be used in a detergent composition, including anionic, nonionic, cationic, and zwitterionic surfactants.

Exemplary surfactants that can be used are commercially available from a number of sources. For a discussion of surfactants, see Kirk-Othmer, Encyclopedia of Chemical Technology, Third Edition, volume 8, pages 900 912, the disclosure of surfactants being incorporated herein by reference. When the detergent composition includes a cleaning agent, the cleaning agent can be provided in an amount effective to provide a desired level of cleaning.

In certain embodiments, the detergent composition includes a surfactant or surfactant system in an amount effective to provide a desired level of cleaning. Preferably, detergent composition contains about 0.01 to 10 wt. %, about 0.1 to 7 wt. %, about 0.5 to 5 wt. % of the surfactant or surfactant system.

In an embodiment the detergent composition does not include an additional anionic surfactant apart from the active agent.

In an embodiment, the composition of the invention includes only nonionic surfactants. That is, except for the branched fatty acid described above, the composition does not include any surfactants other than nonionic surfactants.

Said otherwise, the composition of the invention may be free of or substantially free of cationic, anionic, amphoteric, and zwitterionic surfactants.

Nonionic surfactants useful in detergent compositions include those having a polyalkylene oxide polymer as a portion of the surfactant molecule. Such nonionic surfactants include, for example, chlorine-, benzyl-, methyl-, ethyl-, propyl-, butyl- and other alkyl-capped polyethylene glycol ethers of fatty alcohols; polyalkylene oxide free nonionics such as alkyl polyglycosides; sorbitan and sucrose esters and their ethoxylates; alkoxylated ethylene diamine; alcohol alkoxylates such as alcohol ethoxylate propoxylates, alcohol propoxylates, alcohol propoxylate ethoxylate propoxylates, alcohol ethoxylate butoxylates, and the like; nonylphenol ethoxylate, polyoxyethylene glycol ethers and the like; carboxylic acid esters such as glycerol esters, polyoxyethylene esters, ethoxylated and glycol esters of fatty acids, and the like; carboxylic amides such as diethanolamine condensates, monoalkanolamine condensates, polyoxyethylene fatty acid amides, and the like; and polyalkylene oxide block copolymers including an ethylene oxide/propylene oxide block copolymer such as those commercially available under the trademark PLURONIC (BASF-Wyandotte), and the like; and other like nonionic compounds. Silicone surfactants such as the ABIL B8852 can also be used.

When the detergent composition includes a nonionic surfactant, the nonionic surfactant is preferably provided in an amount of greater than about 0.1 wt. % and up to about 7 wt. %.

Cationic surfactants useful for inclusion in a cleaning composition for sanitizing or fabric softening, include amines such as primary, secondary and tertiary monoamines with $C_{1-8}$ alkyl or alkenyl chains, ethoxylated alkylamines, alkoxylates of ethylenediamine, imidazoles such as a 1-(2-hydroxyethyl)-2-imidazoline, a 2-alkyl-1-(2-hydroxyethyl)-2-imidazoline, and the like; and quaternary ammonium salts, as for example, alkylquaternary ammonium chloride surfactants such as n-alkyl($C_{12}$ $C_{18}$)dimethylbenzyl ammonium chloride, n-tetradecyldimethylbenzylammonium chloride monohydrate, a naphthalene-substituted quaternary ammonium chloride such as dimethyl-1-naphthylmethylammonium chloride, and the like; and other like cationic surfactants.

When the detergent composition includes a cationic surfactant, the cationic surfactant is preferably provided in an amount of greater than about 0.1 wt. % and up to about 20 wt. %.

Zwitterionic surfactants that can be used in the detergent composition include betaines, imidazolines, and propionates. Because the detergent composition may be intended to be used in an automatic dishwashing or warewashing, or clothes washing machine, the surfactants selected, if any surfactant is used, can be those that provide an acceptable level of foaming when used inside a dishwashing or warewashing machine. It should be understood that detergent compositions for use in automatic dishwashing or warewashing machines are generally considered to be low-foaming compositions:

The surfactant can be selected to provide low foaming properties. One would understand that low foaming surfactants that provide the desired level of detersive activity are advantageous in an environment such as a dishwashing machine where the presence of large amounts of foaming can be problematic. In addition to selecting low foaming surfactants, one would understand that defoaming agents can be utilized to reduce the generation of foam. Accordingly, surfactants that are considered low foaming surfactants as well as other surfactants can be used in the detergent composition and the level of foaming may be controlled by the addition of a defoaming agent. One skilled in the art will recognize that selection of appropriate surfactants as taught by the present invention allow the exclusion of defoaming agents. Thus, compositions of the invention may be substantially free of defoaming agents.

The detergent composition includes the surfactant or surfactant system in a range of about 0.05 wt. % to about 20 wt. %, about 0.5 wt. % to about 15 wt. %, about 1 wt. % to about 15 wt. %, about 1.5 wt. % to about 10 wt. %, and about 2 wt. % to about 5 wt. %. Additional exemplary ranges of surfactant in a concentrate include about 0.5 wt. % to about 5 wt. %, and about 1 wt. % to about 3 wt. %.

Additional Functional Materials

As indicated above, detergent compositions of the invention may contain other functional materials that provide the desired properties and functionality to the composition. For the purpose of this application, the term "functional materials" include a material that when dispersed or dissolved in a use and/or concentrate solution, such as an aqueous solution, provides a beneficial property in a particular use. Examples of such a functional material include chelating/sequestering agents; inorganic detergents or alkaline sources; organic detergents, surfactants or cleaning agents; rinse aids; bleaching agents; sanitizers/anti-microbial agents; activators; detergent builders or fillers; anti-redeposition agents; optical brighteners; dyes/odorants; secondary hardening agents/solubility modifiers; pesticides and/or baits for pest control applications; or the like, or a broad variety of other functional materials, depending upon the desired characteristics and/or functionality of the composition. In the context of some embodiments disclosed herein, the functional materials, or ingredients, are optionally included within the solidification matrix for their functional properties. The binding agent acts to bind the matrix, including the functional materials, together to form the solid composition. Some more particular examples of functional materials are discussed in more detail below, but it should be understood by those of skill in the art and others that the particular materials discussed are given by way of example only, and that a broad variety of other functional materials may be used.

Enzyme

Enzymes that can be used according to the invention include enzymes that provide desirable activity for removal of protein-based, carbohydrate-based, or triglyceride-based stains from substrates; for cleaning, destaining, and sanitizing presoaks, such as presoaks for medical and dental instruments, devices, and equipment; presoaks for flatware, cooking ware, and table ware; or presoaks for meat cutting equipment; for machine warewashing; for laundry and textile cleaning and destaining; for carpet cleaning and destaining; for cleaning-in-place and destaining-in-place; for cleaning and destaining food processing surfaces and equipment; for drain cleaning; presoaks for cleaning; and the like. Although not limiting to the present invention, enzymes suitable for the detergent compositions can act by degrading or altering one or more types of soil residues encountered on an instrument or device thus removing the soil or making the soil more removable by a surfactant or other component of the cleaning composition. Both degradation and alteration of soil residues can improve detergency by reducing the physicochemical forces that bind the soil to the instrument or device being cleaned, i.e. the soil becomes more water soluble. For example, one or more proteases can cleave complex, macromolecular protein structures present in soil residues into simpler short chain molecules which are, of themselves, more readily desorbed from surfaces, solubilized or otherwise more easily removed by detersive solutions containing said proteases.

Suitable enzymes include a protease, an amylase, a lipase, a gluconase, a cellulase, a peroxidase, or a mixture thereof of any suitable origin, such as vegetable, animal, bacterial, fungal or yeast origin. Preferred selections are influenced by factors such as pH-activity and/or stability optima, thermo stability, and stability to active detergents, builders and the like. In this respect bacterial or fungal enzymes are preferred, such as bacterial amylases and proteases, and fungal cellulases. Preferably the enzyme is a protease, a lipase, an amylase, or a combination thereof.

"Detersive enzyme", as used herein, means an enzyme having a cleaning, destaining or otherwise beneficial effect as a component of a detergent composition for instruments, devices, or equipment, such as medical or dental instruments, devices, or equipment; or for laundry, textiles, warewashing, cleaning-in-place, drains, carpets, meat cutting tools, hard surfaces, personal care, or the like. Preferred detersive enzymes include a hydrolase such as a protease, an amylase, a lipase, or a combination thereof. Preferred enzymes in detergent compositions for cleaning medical or dental devices or instruments include a protease, an amylase, a cellulase, a lipase, or a combination thereof. Preferred enzymes in detergent compositions for food processing surfaces and equipment include a protease, a lipase, an amylase, a gluconase, or a combination thereof. Preferred enzymes in detergent compositions for laundry or textiles include a protease, a cellulase, a lipase, a peroxidase, or a combination thereof. Preferred enzymes in detergent compositions for carpets include a protease, an amylase, or a combination thereof. Preferred enzymes in detergent compositions for meat cutting tools include a protease, a lipase, or a combination thereof. Preferred enzymes in detergent compositions for hard surfaces include a protease, a lipase, an amylase, or a combination thereof. Enzymes are normally incorporated into a detergent composition according to the invention in an amount sufficient to yield effective cleaning during a washing or presoaking procedure. An amount effective for cleaning refers to an amount that produces a clean, sanitary, and, preferably, corrosion free appearance to the material cleaned, particularly for medical or dental devices or instruments. An amount effective for cleaning also can refer to an amount that produces a cleaning, stain removal, soil removal, whitening, deodorizing, or freshness improving effect on substrates such as medical or dental devices or instruments and the like. Such a cleaning effect can be achieved with amounts of enzyme as low as about 0.1 wt-% of the detergent composition. In the cleaning compositions of the present invention, suitable cleaning can typically be achieved when an enzyme is present at about 1 to about 30 wt-%; preferably about 2 to about 15 wt-%; preferably about 3 to about 10 wt-%; preferably about 4 to about 8 wt-%; preferably about 4, about 5, about 6, about 7, or about 8 wt-%. The higher enzyme levels are typically desirable in highly concentrated cleaning or presoak formulations. A presoak is preferably formulated for use upon a dilution of about 1:500, or to a formulation concentration of about 2000 to about 4000 ppm, which puts the use concentration of the enzyme at about 20 to about 40 ppm.

Commercial enzymes, such as alkaline proteases, are obtainable in liquid or dried form, are sold as raw aqueous solutions or in assorted purified, processed and compounded forms, and include about 2% to about 80% by weight active enzyme generally in combination with stabilizers, buffers, cofactors, impurities and inert vehicles. The actual active enzyme content depends upon the method of manufacture and is not critical; assuming the detergent composition has the desired enzymatic activity. The particular enzyme chosen for use in the process and products of this invention depends upon the conditions of final utility, including the physical product form, use pH, use temperature, and soil types to be degraded or altered. The enzyme can be chosen to provide optimum activity and stability for any given set of utility conditions.

Detergent compositions of the present invention preferably include at least a protease. The detergent composition of the invention has further been found, surprisingly, to significantly stabilize protease activity in use compositions toward digesting proteins and enhancing soil removal. Further, enhanced protease activity can occur in the presence of one or more additional enzymes, such as amylase, cellulase, lipase, peroxidase, endoglucanase enzymes and mixtures thereof, preferably lipase or amylase enzymes.

A valuable reference on enzymes is "Industrial Enzymes", Scott, D., in Kirk-Othmer Encyclopedia of Chemical Technology, 3rd Edition, (editors Grayson, M. and EcKroth, D.) Vol. 9, pp. 173 224, John Wiley & Sons, New York, 1980 incorporated herein by reference in its entirety for all purposes.

Protease

A protease suitable for detergent compositions of the present invention can be derived from a plant, an animal, or a microorganism. Preferably the protease is derived from a microorganism, such as a yeast, a mold, or a bacterium. Preferred proteases include serine proteases active at alkaline pH, preferably derived from a strain of *Bacillus* such as *Bacillus subtilis* or *Bacillus licheniformis*; these preferred proteases include native and recombinant subtilisins. The protease can be purified or a component of a microbial extract, and either wild type or variant (either chemical or recombinant). A preferred protease is neither inhibited by a metal chelating agent (sequestrant) or a thiol poison nor activated by metal ions or reducing agents, has a broad substrate specificity, is inhibited by diisopropylfluorophosphate (DFP), is an endopeptidase, has a molecular weight in the range of about 20,000 to about 40,000, and is active at a pH of about 6 to about 12 and at temperatures in a range from about 20° C. to about 80° C.

Examples of proteolytic enzymes which can be employed in the detergent composition of the invention include (with trade names) Savinase™; a protease derived from *Bacillus lentus* type, such as Maxacal™, Opticlean™, Durazym™, and Properase™; a protease derived from *Bacillus licheniformis*, such as Alcalase™, Maxatase™, Deterzyme™, or Deterzyme PAG 510/220; a protease derived from *Bacillus amyloliquefaciens*, such as Primase™; and a protease derived from *Bacillus alcalophilus*, such as Deterzyme APY. Preferred commercially available protease enzymes include those sold under the trade names Alcalase™, Savinase™, Primaset, Durazym(, or Esperase™ by Novo Industries A/S (Denmark); those sold under the trade names Maxatase™, Maxacal™, or Maxapem™ by Gist-Brocades (Netherlands); those sold under the trade names Purafect™, Purafect™ OX, and Properase™ by Genencor International; those sold under the trade names Opticlean™ or Optimase™ by Solvay Enzymes; those sold under the tradenames Deterzyme™, Deterzyme™ APY, and Deterzyme™ PAG 510/220 by Deerland Corporation, and the like.

A mixture of such proteases can also be used. For example, Purafect™ product is a preferred alkaline protease (a subtilisin) for use in detergent compositions of this invention having application in lower temperature cleaning programs, from about 30° C. to about 65° C.; whereas, Esperase™ product is an alkaline protease of choice for higher temperature detersive solutions, from about 50° C. to about 85° C.

Suitable detersive proteases are described in patent publications including: GB 1,243,784, WO 9203529 A (enzyme/inhibitor system), WO 9318140 A, and WO 9425583 (recombinant trypsin-like protease) to Novo; WO 9510591 A, WO 9507791 (a protease having decreased adsorption and increased hydrolysis), WO 95/30010, WO 95/30011, WO 95/29979, to Procter & Gamble; WO 95/10615 (*Bacillus amyloliquefaciens* subtilisin) to Genencor International; EP 130,756 A (protease A); EP 303,761 A (protease B); and EP 130,756 A. A variant protease employed in the present detergent compositions is preferably at least 80% homologous, preferably having at least 80% sequence identity, with the amino acid sequences of the proteases in these references.

In preferred embodiments of this invention, the amount of commercial alkaline protease present in the composition of the invention ranges from about 1 to about 30 wt-%; preferably about 2 to about 15 wt-%; preferably about 3 to about 10 wt-%; preferably about 4 to about 8 wt-%; preferably about 4, about 5, about 6, about 7, or about 8 wt-%. Typical commercially available detersive enzymes include about 5 10% of active enzyme.

Whereas establishing the percentage by weight of commercial alkaline protease required is of practical convenience for manufacturing embodiments of the present teaching, variance in commercial protease concentrates and in-situ environmental additive and negative effects upon protease activity require a more discerning analytical technique for protease assay to quantify enzyme activity and establish correlations to soil residue removal performance and to enzyme stability within the preferred embodiment and to use-dilution solutions. The activity of the proteases for use in the present invention is readily expressed in terms of activity units—more specifically, Kilo-Novo Protease Units (KNPU) which are azocasein assay activity units well known to the art. A more detailed discussion of the azocasein assay procedure can be found in the publication entitled "The Use of Azoalbumin as a Substrate in the Colorimetric Determination of Peptic and Tryptic Activity", Tomarelli, R. M., Charney, J., and Harding, M. L., J. Lab. Clin. Chem. 34, 428 (1949).

In preferred embodiments of the present invention, the activity of proteases present in the use-solution ranges from about 1.times.$10^{-5}$ KNPU/gm solution to about 4.times.$10^{-3}$ KNPU/gm solution.

Naturally, mixtures of different proteolytic enzymes may be incorporated into this invention. While various specific enzymes have been described above, it is to be understood that any protease which can confer the desired proteolytic activity to the composition may be used and this embodiment of this invention is not limited in any way by specific choice of proteolytic enzyme.

Amylase

An amylase suitable for detergent compositions of the present invention can be derived from a plant, an animal, or a microorganism. Preferably the amylase is derived from a microorganism, such as a yeast, a mold, or a bacterium. Preferred amylases include those derived from a *Bacillus*, such as *B. licheniformis, B. amyloliquefaciens, B. subtilis*, or *B. stearothermophilus*. The amylase can be purified or a component of a microbial extract, and either wild type or variant (either chemical or recombinant), preferably a variant that is more stable under washing or presoak conditions than a wild type amylase.

Examples of amylase enzymes that can be employed in detergent compositions of the invention include those sold under the trade name Rapidase by Gist-Brocades™ (Netherlands); those sold under the trade names Termanyl™, Fungamyl™ or Duramyl™ by Novo; those sold under the trade names Purastar STL or Purastar OXAM by Genencor; those sold under the trade names Thermozyme™ L340 or Deterzyme™ PAG 510/220 by Deerland Corporation; and the like. Preferred commercially available amylase enzymes include the stability enhanced variant amylase sold under the trade name Duramyl™ by Novo. A mixture of amylases can also be used.

Amylases suitable for detergent compositions of the present invention, preferably for warewashing, include: I-amylases described in WO 95/26397, PCT/DK96/00056, and GB 1,296,839 to Novo; and stability enhanced amylases described in J. Biol. Chem., 260(11):6518 6521 (1985); WO 9510603 A, WO 9509909 A and WO 9402597 to Novo; references disclosed in WO 9402597; and WO 9418314 to Genencor International. A variant I-amylase employed in the present detergent compositions containing stabilized enzymes is preferably at least 80% homologous, preferably having at least 80% sequence identity, with the amino acid sequences of the proteins of these references.

Preferred amylases for use in detergent compositions of the present invention have enhanced stability compared to certain amylases, such as Termamyl™. Enhanced stability refers to a significant or measurable improvement in one or more of: oxidative stability, e.g., to hydrogen peroxide/tetraacetylethylenediamine in buffered solution at pH 9 10; thermal stability, e.g., at common wash temperatures such as about 60° C.; and/or alkaline stability, e.g., at a pH from about 8 to about 11; each compared to a suitable control amylase, such as Termamyl™. Stability can be measured by methods known to those of skill in the art. Preferred enhanced stability amylases for use in the detergent compositions of the present invention have a specific activity at least 25% higher than the specific activity of Termamyl™ at a temperature in a range of 25° C. to 55° C. and at a pH in a range of about 8 to about 10. Amylase activity for such comparisons can be measured by assays known to those of skill in the art and/or commercially available, such as the Phadebas™ I-amylase assay.

In preferred embodiments of this invention, the amount of commercial amylase present in the composition of the invention ranges from about 1 to about 30 wt-%; preferably about 2 to about 15 wt-%; preferably about 3 to about 10 wt-%; preferably about 4 to about 8 wt-%; preferably about 4, about 5, about 6, about 7, or about 8 wt-%, of the commercial enzyme product. Typical commercially available detersive enzymes include about 0.25 5% of active amylase.

Whereas establishing the percentage by weight of amylase required is of practical convenience for manufacturing embodiments of the present teaching, variance in commercial amylase concentrates and in-situ environmental additive and negative effects upon amylase activity may require a more discerning analytical technique for amylase assay to quantify enzyme activity and establish correlations to soil residue removal performance and to enzyme stability within the preferred embodiment and to use-dilution solutions. The activity of the amylases for use in the present invention can be expressed in units known to those of skill or through amylase assays known to those of skill in the art and/or commercially available, such as the Phadebas™ 1-amylase assay.

Naturally, mixtures of different amylase enzymes can be incorporated into this invention. While various specific enzymes have been described above, it is to be understood that any amylase which can confer the desired amylase activity to the composition can be used and this embodiment of this invention is not limited in any way by specific choice of amylase enzyme.

Cellulases

A cellulase suitable for detergent compositions of the present invention can be derived from a plant, an animal, or a microorganism. Preferably the cellulase is derived from a microorganism, such as a fungus or a bacterium. Preferred cellulases include those derived from a fungus, such as *Humicola insolens, Humicola* strain DSM1800, or a cellulase 212-producing fungus belonging to the genus *Aeromonas* and those extracted from the hepatopancreas of a marine mollusk, *Dolabella Auricula Solander*. The cellulase can be purified or a component of an extract, and either wild type or variant (either chemical or recombinant).

Examples of cellulase enzymes that can be employed in the detergent composition of the invention include those sold under the trade names Carezyme™ or Celluzym™ by Novo; under the tradename Cellulase™ by Genencor; under the tradename Deerland Cellulase 4000™ or Deerland Cellulase TR™ by Deerland Corporation; and the like. A mixture of cellulases can also be used. Suitable cellulases are described in patent documents including: U.S. Pat. No. 4,435,307, GB-A-2.075.028, GB-A-2.095.275, DE-OS-2.247.832, WO 9117243, and WO 9414951 A (stabilized cellulases) to Novo.

In preferred embodiments of this invention, the amount of commercial cellulase present in the composition of the invention ranges from about 1 to about 30 wt-%; preferably about 2 to about 15 wt-%; preferably about 3 to about 10 wt-%; preferably about 4 to about 8 wt-%; preferably about 4, about 5, about 6, about 7, or about 8 wt-%, of the commercial enzyme product. Typical commercially available detersive enzymes include about 5 10 percent of active enzyme.

Whereas establishing the percentage by weight of cellulase required is of practical convenience for manufacturing embodiments of the present teaching, variance in commercial cellulase concentrates and in-situ environmental additive and negative effects upon cellulase activity may require a more discerning analytical technique for cellulase assay to quantify enzyme activity and establish correlations to soil residue removal performance and to enzyme stability within the preferred embodiment and to use-dilution solutions. The activity of the cellulases for use in the present invention can be expressed in units known to those of skill or through cellulase assays known to those of skill in the art and/or commercially available.

Naturally, mixtures of different cellulase enzymes can be incorporated into this invention. While various specific enzymes have been described above, it is to be understood that any cellulase that can confer the desired cellulase activity to the composition can be used and this embodiment of this invention is not limited in any way by specific choice of cellulase enzyme.

Lipases

A lipase suitable for detergent compositions of the present invention can be derived from a plant, an animal, or a microorganism. Preferably the lipase is derived from a microorganism, such as a fungus or a bacterium. Preferred lipases include those derived from a *Pseudomonas*, such as *Pseudomonas stutzeri* ATCC 19.154, or from a *Humicola*, such as *Humicola lanuginosa*. (typically produced recombinantly in *Aspergillus oryzae*). The lipase can be purified or a component of an extract, and either wild type or variant (either chemical or recombinant).

Examples of lipase enzymes that can be employed in detergent compositions of the invention include those sold under the trade names Lipase P Amano™ or Amano-P™ by Amano Pharmaceutical Co. Ltd., Nagoya, Japan or under the trade name Lipolase™ by Novo, and the like. Other commercially available lipases that can be employed in the present compositions include Amano-CES™, lipases derived from *Chromobacter viscosum*, e.g. *Chromobacter viscosum* var. *lipolyticum* NRRLB 3673 from Toyo Jozo Co., Tagata, Japan; *Chromobacter viscosum* lipases from U.S. Biochemical Corp., U.S.A. and Disoynth Co., and lipases derived from *Pseudomonas gladioli* or from *Humicola lanuginosa*. A preferred lipase is sold under the trade name Lipolase™ by Novo.

Suitable lipases are described in patent documents including: WO 9414951 A (stabilized lipases) to Novo, WO 9205249, RD 94359044, GB 1,372,034, Japanese Patent Application 53,20487, laid open Feb. 24, 1978 to Amano Pharmaceutical Co. Ltd., and EP 341,947.

In preferred embodiments of this invention, the amount of commercial lipase present in the composition of the invention ranges from about 1 to about 30 wt-%; preferably about 2 to about 15 wt-%; preferably about 3 to about 10 wt-%; preferably about 4 to about 8 wt-%; preferably about 4, about 5, about 6, about 7, or about 8 wt-%, of the commercial enzyme product. Typical commercially available detersive enzymes include about 5-10 percent of active enzyme.

Whereas establishing the percentage by weight of lipase required is of practical convenience for manufacturing embodiments of the present teaching, variance in commercial lipase concentrates and in-situ environmental additive and negative effects upon lipase activity may require a more discerning analytical technique for lipase assay to quantify enzyme activity and establish correlations to soil residue removal performance and to enzyme stability within the preferred embodiment and to use-dilution solutions. The activity of the lipases for use in the present invention can be expressed in units known to those of skill or through lipase assays known to those of skill in the art and/or commercially available.

Naturally, mixtures of different lipase enzymes can be incorporated into this invention. While various specific enzymes have been described above, it is to be understood that any lipase that can confer the desired lipase activity to the composition can be used and this embodiment of this invention is not limited in any way by specific choice of lipase enzyme.

Additional Enzymes

Additional enzymes suitable for use in the present detergent compositions include a cutinase, a peroxidase, a gluconase, and the like. Suitable cutinase enzymes are described in WO 8809367 A to Genencor. Known peroxidases include horseradish peroxidase, ligninase, and haloperoxidases such as chloro- or bromo-peroxidase. Peroxidases suitable for detergent compositions are disclosed in WO 89099813 A and WO 8909813 A to Novo. Peroxidase enzymes can be used in combination with oxygen sources, e.g., percarbonate, percarbonate, hydrogen peroxide, and the like. Additional enzymes suitable for incorporation into the present detergent composition are disclosed in WO 9307263 A and WO 9307260 A to Genencor International, WO 8908694 A to Novo, and U.S. Pat. No. 3,553,139 to McCarty et al., U.S. Pat. No. 4,101,457 to Place et al., U.S. Pat. No. 4,507,219 to Hughes and U.S. Pat. No. 4,261,868 to Hora et al.

An additional enzyme, such as a cutinase or peroxidase, suitable for the detergent composition of the present invention can be derived from a plant, an animal, or a microorganism. Preferably the enzyme is derived from a microorganism. The enzyme can be purified or a component of an extract, and either wild type or variant (either chemical or recombinant). In preferred embodiments of this invention, the amount of commercial additional enzyme, such as a cutinase or peroxidase, present in the composition of the invention ranges from about 1 to about 30 wt-%, preferably about 2 to about 15 wt-%, preferably about 3 to about 10 wt-%, preferably about 4 to about 8 wt-%, of the commercial enzyme product. Typical commercially available detersive enzymes include about 5 10 percent of active enzyme.

Whereas establishing the percentage by weight of additional enzyme, such as a cutinase or peroxidase, required is of practical convenience for manufacturing embodiments of the present teaching, variance in commercial additional enzyme concentrates and in-situ environmental additive and negative effects upon their activity may require a more discerning analytical technique for the enzyme assay to quantify enzyme activity and establish correlations to soil residue removal performance and to enzyme stability within the preferred embodiment and to use-dilution solutions. The activity of the additional enzyme, such as a cutinase or peroxidase, for use in the present invention can be expressed in units known to those of skill or through assays known to those of skill in the art and/or commercially available.

Naturally, mixtures of different additional enzymes can be incorporated into this invention. While various specific enzymes have been described above, it is to be understood that any additional enzyme that can confer the desired enzyme activity to the composition can be used and this embodiment of this invention is not limited in any way by specific choice of enzyme.

Enzyme Stabilizing System

The enzyme stabilizing system of the present invention includes a mixture of carbonate and bicarbonate. The enzyme stabilizing system can also include other ingredients to stabilize certain enzymes or to enhance or maintain the effect of the mixture of carbonate and bicarbonate.

Stabilizing systems of certain cleaning compositions, for example medical or dental instrument or device detergent compositions, may further include from 0 to about 10%, preferably from about 0.01% to about 6% by weight, of chlorine bleach scavengers, added to prevent chlorine bleach species present in many water supplies from attacking and inactivating the enzymes, especially under alkaline conditions. While chlorine levels in water may be small, typically in the range from about 0.5 ppm to about 1.75 ppm, the available chlorine in the total volume of water that comes in contact with the enzyme, for example during warewashing, can be relatively large; accordingly, enzyme stability to chlorine in-use can be problematic. Since percarbonate or percarbonate, which have the ability to react with chlorine bleach, may be present in certain of the instant compositions in amounts accounted for separately from the stabilizing system, the use of additional stabilizers against chlorine, may most generally, not be essential, though improved results may be obtainable from their use.

Suitable chlorine scavenger anions are widely known and readily available, and, if used, can be salts containing ammonium cations with sulfite, bisulfite, thiosulfite, thiosulfate, iodide, etc. Antioxidants such as carbamate, ascorbate, etc., organic amines such as ethylenediaminetetracetic acid (EDTA) or alkali metal salt thereof, monoethanolamine (MEA), and mixtures thereof can likewise be used. Likewise, special enzyme inhibition systems can be incorporated such that different enzymes have maximum compatibility. Other conventional scavengers such as bisulfate, nitrate, chloride, sources of hydrogen peroxide such as sodium percarbonate tetrahydrate, sodium percarbonate monohydrate and sodium percarbonate, as well as phosphate, condensed phosphate, acetate, benzoate, citrate, formate, lactate, malate, tartrate, salicylate, etc., and mixtures thereof can be used if desired.

In general, since the chlorine scavenger function can be performed by ingredients separately listed under better recognized functions, there is no requirement to add a separate chlorine scavenger unless a compound performing that function to the desired extent is absent from an enzyme-containing embodiment of the invention; even then, the scavenger is added only for optimum results. Moreover, the formulator will exercise a chemist's normal skill in avoiding the use of any enzyme scavenger or stabilizer that is unacceptably incompatible, as formulated, with other reactive ingredients. In relation to the use of ammonium salts, such salts can be simply admixed with the detergent composition but are prone to adsorb water and/or liberate ammonia during storage. Accordingly, such materials, if present, are desirably protected in a particle such as that described in U.S. Pat. No. 4,652,392, Baginski et al.

Sanitizers

Sanitizing agents also known as antimicrobial agents are chemical compositions that can be used to prevent microbial contamination and deterioration of commercial products material systems, surfaces, etc. Generally, these materials fall in specific classes including phenolics, halogen compounds, quaternary ammonium compounds, metal derivatives, amines, alkanol amines, nitro derivatives, analides, organosulfur and sulfur-nitrogen compounds and miscellaneous compounds. The given antimicrobial agent depending on chemical composition and concentration may simply limit further proliferation of numbers of the microbe or may destroy all or a substantial proportion of the microbial population. The terms "microbes" and "microorganisms" typically refer primarily to bacteria and fungus microorganisms. In use, the antimicrobial agents are formed into a solid functional material that when diluted and dispensed using an aqueous stream forms an aqueous disinfectant or sanitizer composition that can be contacted with a variety of surfaces resulting in prevention of growth or the killing of a substantial proportion of the microbial population. A five fold reduction of the microbial population results in a sanitizer composition. Common antimicrobial agents include phenolic antimicrobials such as pentachlorophenol, orthophenylphenol. Halogen containing antibacterial agents include sodium trichloroisocyanurate, sodium dichloroisocyanurate (anhydrous or dihydrate), iodine-poly(vinylpyrrolidinonen) complexes, bromine compounds such as 2-bromo-2-nitropropane-1,3-diol quaternary antimicrobial agents such as benzalconium chloride, cetylpyridiniumchloride, amine and nitro containing antimicrobial compositions such as hexahydro-1,3,5-tris(2-hydroxyethyl)-s-triazine, dithiocarbamates such as sodium dimethyldithiocarbamate, and a variety of other materials known in the art for their microbial properties. Sanitizers may be encapsulated to improve stability and/or to reduce reactivity with other materials in the solid detergent composition.

Bleaching Agents

Bleaching agents for use in detergent compositions of the invention are optionally included for lightening or whitening a substrate, include bleaching compounds substantially free of chlorine. A bleaching agent may be a peroxygen or active oxygen source such as hydrogen peroxide, perborates, sodium carbonate peroxyhydrate, phosphate peroxyhydrates, potassium permonosulfate, and sodium perborate mono and tetrahydrate, with and without activators such as tetraacetylethylene diamine, and the like. Detergent compositions of the invention may include a minor but effective amount of a bleaching agent, preferably about 0.1 to 10 wt. %, preferably about 1 to 6 wt. %.

Defoaming Agents

A minor but effective amount of a defoaming agent for reducing the stability of foam may also be included in the present detergent compositions. Preferably, detergent compositions of the invention include about 0.0001 to 5 wt. % of a defoaming agent, preferably about 0.01 to 3 wt. %. However, one skilled in the art will recognize that based upon the composition being substantially free of anionic surfactants apart from the branched fatty acid and the salts thereof, the composition of the invention is very low foaming. That is, in an embodiment the composition of the invention is substantially free of defoaming agents and despite the absence of defoaming agents, the composition does not create foam when diluted in water and/or when agitated.

In the event that a defoaming agent were added, examples of defoaming agents include silicone compounds such as silica dispersed in polydimethylsiloxane, fatty amides, hydrocarbon waxes, fatty acids, fatty esters, fatty alcohols, fatty acid soaps, ethoxylates, mineral oils, polyethylene glycol esters, alkyl phosphate esters such as monostearyl phosphate, and the like. A discussion of defoaming agents may be found, for example, in U.S. Pat. No. 3,048,548 to Martin et al., U.S. Pat. No. 3,334,147 to Brunelle et al., and U.S. Pat. No. 3,442,242 to Rue et al., the disclosures of which are incorporated herein by reference in their entirety for all purposes.

Anti-Redeposition Agents

Detergent compositions of the invention may also include an anti-redeposition agent capable of facilitating sustained suspension of soils in a use solution and preventing the removed soils from being redeposited onto the substrate being cleaned. Examples of suitable anti-redeposition agents include fatty acid amides, fluorocarbon surfactants, complex phosphate esters, styrene maleic anhydride copolymers, and cellulosic derivatives such as hydroxyethyl cellulose, hydroxypropyl cellulose, and the like. A detergent composition may include about 0.5 to 10 wt. %, about 1 to 5 wt. %, of an anti-redeposition agent.

Dyes/Fragrances

Various dyes, odorants including perfumes, and other aesthetic enhancing agents may also be included in the composition. Dyes may be included to alter the appearance of the composition, as for example, Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical), Sap Green (Keyston Analine and Chemical), Metanil Yellow (Keystone Analine and Chemical), Acid Blue 9 (Hilton Davis), Sandolan Blue/Acid Blue 182 (Sandoz), Hisol Fast Red (Capitol Color and Chemical), Fluorescein (Capitol Color and Chemical), Acid Green 25 (Ciba-Geigy), and the like.

Fragrances or perfumes that may be included in the compositions include, for example, terpenoids such as citronellol, aldehydes such as amyl cinnamaldehyde, a jasmine such as C1S-jasmine or jasmal, vanillin, and the like.

Other Ingredients

A wide variety of other ingredients useful in detergent compositions can be included in the compositions hereof, including other active ingredients, builders, carriers, processing aids, dyes or pigments, perfumes, solvents for liquid formulations, hydrotropes (as described below), etc. Low molecular weight primary or secondary alcohols exemplified by methanol, ethanol, propanol, and isopropanol are suitable. Monohydric alcohols are preferred for solubilizing surfactant, but polyols such as those containing from about 2 to about 6 carbon atoms and from about 2 to about 6 hydroxy groups (e.g., propylene glycol, ethylene glycol, glycerine, and 1,2-propanediol) can also be used.

Manufacturing the Solid Detergent Composition

The invention provides a method for manufacturing a solid detergent composition. According to the invention, the active agent, alkaline source, water conditioning agent, solidification agent, and other additives, as desired, are mixed together in a mixing system. Preferably, the mixing system is sufficient to provide dispersion of the binding agent throughout the detergent composition. Heat may be applied from an external source to facilitate processing of the mixture.

A mixing system provides for continuous mixing of the ingredients at high shear to form a substantially homogeneous liquid or semi-solid mixture in which the ingredients are distributed throughout its mass. Preferably, the mixing system includes means for mixing the ingredients to provide shear effective for maintaining the mixture at a flowable consistency, with a viscosity during processing of greater than about 1,000 cps, preferably 1,000 1,000,000 cps, and more preferably about 50,000 200,000 cps. The mixing system is preferably a continuous flow mixer or more preferably, a single or twin screw extruder apparatus, with a twin-screw extruder being highly preferred.

The mixture is typically processed at a temperature to maintain the physical and chemical stability of the ingredients, preferably at ambient temperatures of about 20-80° C., more preferably about 25-55° C. Although limited external heat may be applied to the mixture, the temperature achieved by the mixture may become elevated during processing due to friction, variances in ambient conditions, and/or by an exothermic reaction between ingredients. Optionally, the temperature of the mixture may be increased, for example, at the inlets or outlets of the mixing system.

An ingredient may be in the form of a liquid or a solid such as a dry particulate, and may be added to the mixture separately or as part of a premix with another ingredient, as for example, the cleaning agent, the aqueous medium, and additional ingredients such as a second cleaning agent, a detergent adjuvant or other additive, a secondary hardening agent, and the like. One or more premixes may be added to the mixture.

The ingredients are mixed to form a substantially homogeneous consistency wherein the ingredients are distributed substantially evenly throughout the mass. The mixture is then discharged from the mixing system through a die or other shaping means. The profiled extrudate then can be divided into useful sizes with a controlled mass. Preferably, the extruded solid is packaged in film. The temperature of the mixture when discharged from the mixing system is preferably sufficiently low to enable the mixture to be cast or extruded directly into a packaging system without first cooling the mixture. The time between extrusion discharge and packaging may be adjusted to allow the hardening of the detergent block for better handling during further processing and packaging. Preferably, the mixture at the point of discharge is about 20 90° C., preferably about 25-55° C. The composition is then allowed to harden to a solid form that may range from a low density, sponge-like, malleable, caulky consistency to a high density, fused solid, concrete-like block.

Optionally, heating and cooling devices may be mounted adjacent to mixing apparatus to apply or remove heat in order to obtain a desired temperature profile in the mixer. For example, an external source of heat may be applied to one or more barrel sections of the mixer, such as the ingredient inlet section, the final outlet section, and the like, to increase fluidity of the mixture during processing. Preferably, the temperature of the mixture during processing, including at the discharge port, is maintained preferably at about 20-90° C.

When processing of the ingredients is completed, the mixture may be discharged from the mixer through a discharge die. The composition eventually hardens. The solidification process may last from a few minutes to about six hours, depending, for example, on the size of the extruded composition, the ingredients of the composition, the temperature of the composition, and other like factors. Preferably, the extruded composition "sets up" or begins to hardens to a solid form within about 1 minute to about 3 hours, preferably about 1 minute to about 2 hours, preferably about 1 minute to about 20 minutes.

The packaging receptacle or container may be rigid or flexible, and composed of any material suitable for containing the compositions produced according to the invention, as for example glass, metal, plastic film or sheet, cardboard, cardboard composites, paper, and the like.

Advantageously, since the composition is processed at or near ambient temperatures, the temperature of the processed mixture is low enough so that the mixture may be cast or extruded directly into the container or other packaging system without structurally damaging the material. As a result, a wider variety of materials may be used to manufacture the container than those used for compositions that processed and dispensed under molten conditions. Preferred packaging used to contain the compositions is manufactured from a flexible, easy opening film material.

The packaging material can be provided as a water soluble packaging material such as a water soluble packaging film. Exemplary water soluble packaging films are disclosed in U.S. Pat. Nos. 6,503,879; 6,228,825; 6,303,553; 6,475,977; and 6,632,785, the disclosures of which are incorporated herein by reference in their entirety for all purposes. An exemplary water soluble polymer that can provide a packaging material that can be used to package the concentrate includes polyvinyl alcohol. The packaged concentrate can be provided as unit dose packages or multiple dose packages. In the case of unit dose packages, it is expected that a single packaged unit will be placed in a dishwashing machine, such as the detergent compartment of the dishwashing machine, and will be used up during a single wash cycle. In the case of a multiple dose package, it is expected that the unit will be placed in a hopper and a stream of water will degrade a surface of the concentrate to provide a liquid concentrate that will be introduced into the dishwashing machine.

Suitable water soluble polymers which may be used in the invention are described in Davidson and Sittig, Water Soluble Resins, Van Nostrand Reinhold Company, New York (1968), herein incorporated by reference. The water soluble polymer should have proper characteristics such as strength and pliability in order to permit machine handling. Preferred water soluble polymers include polyvinyl alcohol, cellulose ethers, polyethylene oxide, starch, polyvinylpyrrolidone, polyacrylamide, polyvinyl methyl ether-maleic anhydride, polymaleic anhydride, styrene maleic anhydride, hydroxyethylcellulose, methylcellulose, polyethylene glycols, carboxymethylcellulose, polyacrylic acid salts, alginates, acrylamide copolymers, guar gum, casein, ethylene-maleic anhydride resin series, polyethyleneimine, ethyl hydroxyethylcellulose, ethyl methylcellulose, hydroxyethyl methylcellulose. Lower molecular weight water soluble, polyvinyl alcohol film-forming polymers are generally, preferred. Polyvinyl alcohols that can be used include those having a weight average molecular weight of between about 1,000 and about 300,000, and between about 2,000 and about 150,000, and between about 3,000 and about 100,000.

Dispensing the Solid Detergent Composition

The solid detergent composition made according to the present invention can be dispensed from a spray-type dispenser such as that disclosed in U.S. Pat. Nos. 4,826,661, 4,690,305, 4,687,121, 4,426,362 and in U.S. Pat. Nos. Re 32,763 and 32,818, the disclosures of which are incorporated by reference herein in their entirety for all purposes. Briefly, a spray-type dispenser functions by impinging a water spray upon an exposed surface of the solid composition to dissolve a portion of the composition, and then immediately directing the concentrate solution comprising the composition out of the dispenser to a storage reservoir or directly to a point of use. When used, the product is removed from the package (e.g.) film and is inserted into the dispenser. The spray of water can be made by a nozzle in a shape that conforms to the solid detergent shape. The dispenser enclosure can also closely fit the detergent shape in a dispensing system that prevents the introduction and dispensing of an incorrect detergent.

When the solid detergent composition is provided as a unit dose, the solid detergent composition can be introduced into the cleaning environment to form the use solution. In the case of a warewashing machine, the unit dose can be dropped into the warewashing machine. The unit dose can be hand dropped into the warewashing machine or it can be dispensed mechanically into the warewashing machine. In addition, the unit dose can be used to form a concentrate that is then introduced into the warewashing machine.

Use

A detergent composition can be referred to as a concentrate composition as the cleaning composition, or as the composition. Solid or liquid detergent compositions can be available for cleaning in environments including automatic dishwashing or warewashing machines, use as rinse aids therein, laundry, a pot and pan cleaner, cleaner for rotary fryers and deep fat fryers, floors, and for manual cleaning glass, dishes, etc. in a sink. Furthermore, detergent compositions of the invention can refer to the composition provided in the form of a concentrate or provided in the form of a use composition. In general, a concentrate is the composition that is intended to be diluted with water to provide the use composition that contacts the surface to provide the desired effect, such as, cleaning. Furthermore, the detergent composition can be used in environments including, for example, bottle washing and car washing.

The solid or liquid detergent composition that is dissolved or diluted for contact with the articles to be cleaned can be referred to as the "use composition" or "use solution." The use composition can be provided at a concentration that provides a desired level of detersive properties. The solids concentration refers to the concentration of the non-water components in the use composition. The solid detergent composition prior to dilution to provide the use composition can be referred to as the solid composition, the solid detergent composition, or as the concentrate.

The solid detergent composition can be used by dissolving the concentrate with water or other aqueous media at the situs or location of use to provide the use composition. In many cases when using the solid detergent composition in an automatic dishwashing or warewashing machine, it is expected that that situs or location of use will be inside the automatic dishwashing or warewashing machine. When the solid detergent composition is used in a residential or home-style dishwashing machine, the composition can be placed in the detergent compartment of the dishwashing machine. Often the detergent compartment is located in the door of the dishwashing machine. The solid detergent composition can be provided in the form that allows for introduction of a single dose of the solid detergent composition into the compartment. In general, a single dose refers to the amount of the solid detergent composition that is desired for a single warewashing cycle. In many commercial dishwashing or warewashing machines, and even for certain residential or home-style dishwashing machines, it is expected that a large quantity of solid detergent composition can be provided in a compartment that allows for the release of a single dose amount of the composition for each warewashing or dishwashing cycle. Such a compartment may be provided as part of the warewashing or dishwashing machine or it may be provided as a separate structure connected to the warewashing or dishwashing machine by a hose for delivery of the composition to the warewashing or dishwashing machine. For example, a block of the solid detergent composition can be provided in a hopper, and water can be sprayed against the surface of the block to provide a liquid concentrate that can be introduced into the dishwashing machine. The hopper can be a part of the dishwashing machine or it can be provided separate from the dishwashing machine.

The water that is used to dilute the concentrate to form the use composition can be referred to as water of dilution, and can vary from one location to another. It is expected that water available at one location may have a relatively low level of total dissolved solids while water at another location may have a relatively high level of total dissolved solids. In general, hard water is considered to be water having a total dissolved solids content in excessive of 200 ppm. The warewashing detergent composition according to the invention can be provided so that detergency properties are provided in the presence of water of dilution that is soft water or water of dilution that is hard water.

The use composition can have a solids content that is sufficient to provide the desired level of cleaning while avoiding wasting the concentrated detergent composition by using too much. In most embodiments, the solids present in the use solution are stable in solution, meaning that they remain dispersed in the use solution without precipitation and rapid degradation during use. In general, the use composition can have a solids content of at least about 0.05 wt. % to provide a desired level of cleaning. In addition, the use composition can have a solids content of less than about 1.0 wt. % to avoid using too much of the composition. In addition, the use composition can have a solids content of about 0.05 wt. % to about 0.75 wt. %. In certain embodiments, the solid detergent composition readily dissolves in aqueous media to form a use solution having a solids content of about 3-5 wt. %, in further embodiments, about 4 wt. %. The use composition can be prepared from the concentrate by diluting with water at a dilution ratio that provides convenient use of the concentrate and provides the formation of a use composition having desired detersive properties. The concentrate can be diluted at a ratio of water to concentrate of at least about 20:1, and can be at about 20:1 to about 2000:1, to provide a use composition having desired detersive properties. In use solutions, embodiments of the invention include between about 200 and 6,000 ppm detergent solids content, between about 400 and 5,500 ppm, and between about 500 and 5,000 ppm detergent solids content. The above specification provides a basis for understanding the broad metes and bounds of the invention. The following examples and test data provide an understanding of certain specific embodiments of the invention. The examples are not meant to limit the scope of the invention that has been set forth in the foregoing description. Variations within the concepts of the invention are apparent to those skilled in the art.

The following examples are provided for the purpose of illustration, not limitation.

EXAMPLES

Materials and Suppliers

Cola®Trope INC or Cola®Trope INC-K both sodium isononanoate from Colonial Chemical, Inc. Chattanooga, Tenn.

Plurafac® LF901, a surfactant available from BASF Chemical Company located in Germany.

Test Methods

The following test method provides a method for analyzing stain removal of fish-stain soiled tiles.

Fish soil was prepared by blending 100 g of raw white fish with 200 g of deionized water. The fish pulp was centrifuged and resulted in three layers, a thick protein layer at the bottom, a liquid fish 'juice' in the center, and the fish fat at the surface. The center layer (the "fish juice") was extracted and is referred to herein as the supernatant. The supernatant fluid was used for only one week because samples retained longer than two weeks became nonhomogeneous resulting in solids precipitating out of solution. The solution was stored at refrigeration temperatures, around 40 degrees F., to avoid freezing or heating of the supernatant.

Tiles were prepared according to the following protocol. White ceramic tiles were first washed with deionized ("DI") water. The tile surface was then washed with acetone. Masking tape was placed at the top of the tile to protect a one inch strip from being soiled. A 0.5 mL volume of the supernatant was prepared according to the above paragraph and was pipetted onto the edge of the tile bordering the masking tape. A wet film applicator rod was used to spread the fish evenly across the surface of the tile. The tile was allowed to dry at ambient conditions and application and spreading of the soil was repeated twice so that each tile had three dried layers of fish on the surface.

The wet film applicator rod was a size 20 purchased from Paul Gardner Company, Inc. located in Pompano Beach, Fla. The rod laid down a wet film thickness of 0.51 mm. The rod was ¼ inch in diameter and had a 12 inch effective coating path. The wire diameter was 0.02 inches.

White matte 4×4 tiles were prepared having multiple layers of soil. Three tiles were prepared having varying numbers of soil layers from one to three layers. The soils were then stained with Coomassie blue, a dye that stains protein. The surface of these tiles was evaluated visually. The darkest tiles had the most Coomassie dye and therefore had the most protein on them. The visual grades for the tiles are given as follows:

| Visual Grade | Description |
|---|---|
| 1 | No dye |
| 2 | Trace Blue |
| 3 | Slightly Light Blue |
| 4 | Light Blue |
| 5 | Medium-light Blue |
| 6 | Medium Blue |
| 7 | Medium-Dark Blue |
| 8 | Dark Blue |
| 9 | Very dark blue |
| 10 | Saturated with Dye |

Visual results were graded by the same person, considered an expert at grading these dyes to give consistency to the grading. The smaller the grade is the less protein soil that exists on the surface of the tile. The smaller the visual grade is the better the cleaning performance of the detergent.

Results showed that the most evenly soiled tiles were those soiled three times after a thorough initial cleaning.

Example 1

This example demonstrates the efficacy of compositions of the present invention at removing raw fish soil in stagnant water.

A solution of 1500 ppm detergent was prepared according to the following formula:

| Component | % by Weight |
|---|---|
| Sodium Carbonate | 52.13 |
| Trisodium NTA monohydrate | 19.83 |
| Sodium Polyacrylate | 0.98 |
| Calcium Chloride | 1.01 |
| Sodium bicarbonate | 2.88 |
| Sodium Metasilicate | 3.00 |
| Sodium Aluminate | 0.20 |
| Pentasodium Diethylenetriaminepentaacetic acid | 11.58 |
| Diethylenetriaminepentaacetic acid | 0.71 |
| Citric Acid | 2.06 |
| Sodium Aluminate | 1.04 |
| Lauryl Alcohol | 3.53 |
| Ethoxy-propoxy copolymer | 1.06 |

Ceramic tiles were soiled according to the above test method. The soiled tiles were placed in a solution of 1500 ppm detergent with 5 wt % active agent (or 75 ppm) at 150° F. for 5 minutes in 5 grains per gallon (gpg) water. The potential active agent additives were selected from the following table:

| Tested Active Agent |
|---|
| Potassium Carbonate |
| Potassium Chloride |
| Isononanoic Acid Sodium Salt |
| Accusol ™ 445 (Rohm & Haas) |
| Percarbonate |
| BLVD Enzymes |
| Nitrilotriacetic acid |
| Sodium xylene sulfonate |
| Sodium Sulfate |
| Sodium Hydroxide |
| Pluronic ™ N3 (BASF Chemicals) |

The tile was then removed and rinsed in stagnant 120° F. 5 gpg water. The tile was visually evaluated for cleanliness. Of the entire potential active agent additives tested, only a few resulted in improved soil removal over use of the detergent alone. These additives were the active agents: potassium carbonate, potassium chloride, and isononanoic acid sodium salt, commercially available as Cola®Trope INC from Colonial Chemical, Inc.

Example 2

This example demonstrates protein buildup in an automatic warewashing machine using detergent with and without Cola®Trope INC sodium isononanoate over 10-cycles. Detergent was prepared according to the formula provided in Example 1 above. Five percent Cola®Trope INC sodium isononanoate was added to the detergent for half of the samples. Detergent alone was used for the other, half of the samples.

Ten tiles were soiled as provided above and washed in an AM14 automatic dishwasher available from Hobart located in Troy, Ohio with a wash and rinse cycle of 70 seconds. After the cycles were complete, the tiles were taken out of the machine. A first was set aside and the remaining 9 tiles were soiled and rewashed. After every cycle a tile was removed until the buildup of soil could be seen over 10 cycles on a single tile. The results of this demonstrated that the tiles using 1500 ppm detergent with a 5% wt % Cola®Trope INC sodium isononanoate active agent additive were substantially cleaner than those tiles cleaned with 1500 ppm detergent alone.

Blue dye from the Coomassie blue highlighted the protein present on the tiles. The darkest areas on the tiles showed where the most protein was present. Results are shown in FIG. 1.

It was Example demonstrates that including the active agent additive along with the detergent improved the overall cleaning performance.

Example 3

Figure 2:
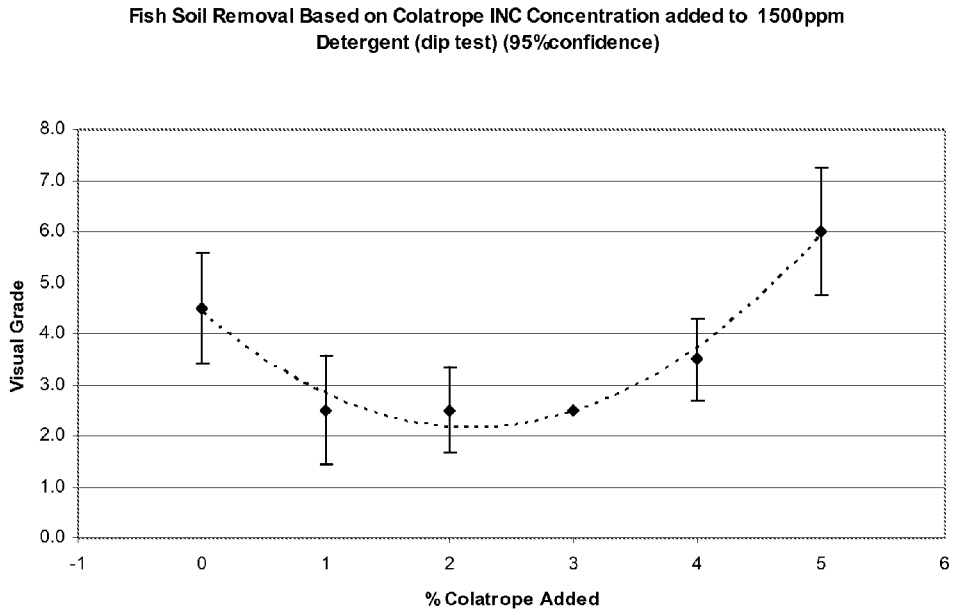
FIG. 2 has an x and y axis. The x-axis is a measure of the concentration of Cola®Trope INC (sodium isononanoate available from Colonial Chemical, Inc.) added to the detergent. The y-axis is a measure of the visual grade. The visual grade is an indicator of protein removal with the lowest visual grade signifying the greatest amount of protein removal.
Figure 3:
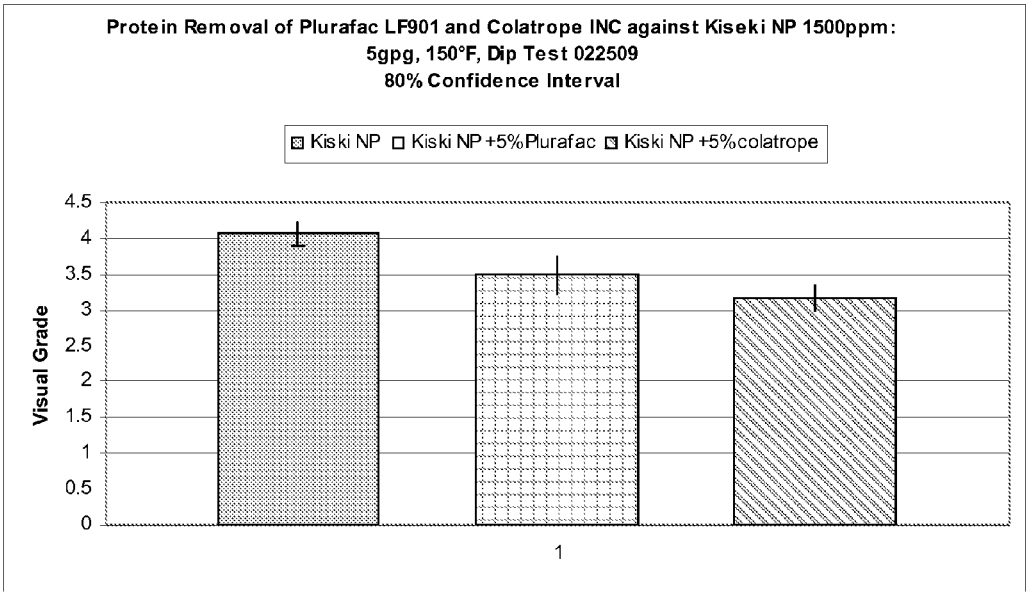
FIG. 3 is a graph depicting the visual grade, an indicator of protein removal with the lowest grade signifying the greatest amount of protein removal, of different detergents

This Example demonstrates improved soil removal within a range of active agent concentration Detergent was prepared according to the formula provided in Example 1. Cola®Trope INC sodium isononanoate was added to the detergent in varying concentrations and soiled tiles were placed in use solutions according to the protocol of Example 1. The tiles were visually inspected. Results showed that soil removal was maximized when the active agent used was Cola®Trope INC sodium isononanoate at a concentration of between about 0.5 and 4 wt %, between about 1 and 3% wt %, or about 2 wt % resulting in about 30 ppm actives Cola®Trope INC sodium isononanoate. Results are shown in FIG. 2.

Example 4

The detergent of Example 1 was prepared and used in this Example. Varying amounts of Plurafac® LF901 (an alcohol alkoxylate surfactant commercially available from BASF) and sodium isononanoate were added to the detergent to test effectiveness at removing raw fish soil. Plurafac® LF901 surfactant and isononanoate were separately added to the detergent at concentrations of 75 ppm, 150 ppm, and 300 ppm. In this case ceramic plates rather than ceramic tiles were coated with the fish protein and fish oil combination. The soiled plates were washed in an automatic dishwasher along with the detergent and active agent. The fish soil was stained with Coomassie blue as described previously. Once washing was complete, the plates were visually inspected for soil removal. The following grading system was used to grade the washed plates:

| Grade | |
|---|---|
| 1 | Very dark blue |
| 2 | Dark blue |
| 3 | Medium blue |
| 3.5 | Slightly light blue |
| 4 | Light blue |
| 4.5 | Trace blue |
| 5 | No blue |

Cleaning performance of each of the detergent along with varying amounts of active agent is provided in the table below:

| Amount Active Agent | Cleaning Grade |
|---|---|
| 75 ppm Sodium Isononanoate | 3.8 |
| 150 ppm Sodium Isononanoate | 3.9 |
| 300 ppm Sodium Isononanoate | 4.0 |
| 75 ppm Plurafac ® LF901 surfactant | 3.8 |
| 150 ppm Plurafac ® LF901 surfactant | 4.0 |
| 300 ppm Plurafac ® LF901 surfactant | 4.5 |

The results show that increasing the amount of Plurafac® LF901 surfactant and sodium isononanoate improved the protein removal on the surface of the ware.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. A solid detergent composition comprising:

an alkaline source consisting of alkali metal carbonate in an amount effective to provide a use solution having a pH of at least about 9.5;

water conditioning agent in an amount of about 1 to 50 wt. %;

an active agent consisting essentially of a branched fatty acid represented by the formula $CH_3(CH_2)_m(CR_1R_2)_n(CH_2)_o(C R_1R_2)_p(CH_2)_qCOOH$ wherein m, n, o, p and q are each an integer selected from 0-17, and n+p is 1 or 2, and m+n+o+p+q is between 3 and 18 and wherein $R_1$ and $R_2$ are independently a hydrogen or alkyl group with at least one being an alkyl group or combinations thereof;

a solidification agent consisting of alkali metal carbonate and alkali metal bicarbonate;

water in an amount of about 1 wt. % to about 5 wt. %; and wherein the solid detergent composition is substantially free of chlorine.

2. The solid detergent composition of claim 1, wherein the active agent is a salt of a branched fatty acid, the fatty acid represented by the formula $CH_3(CH_2)_m(CR_1R_2)_n(CH_2)_o(C R_1R_2)_p(CH_2)_qCOOH$ wherein m, n, o, p and q are each an integer selected from 0-17, and n+p is 1 or 2, and m+n+o+p+q is between 6 and 12 and wherein $R_1$ and $R_2$ are independently a hydrogen or alkyl group with at least one being an alkyl group.

3. The solid detergent composition of claim 1, wherein the active agent is a $C_8$- $C_{12}$ branched fatty acid.

4. The solid detergent composition of claim 1, wherein the active agent is a sodium or potassium salt of a branched fatty acid selected from the group consisting of sodium isononanoate, sodium isooctanoate, sodium neodecanoate, sodium neopentanoate, sodium neoheptanoate, or mixtures thereof.

5. The solid detergent composition of claim 1, wherein the active agent is a salt of a branched fatty acid consisting of sodium isononanoate.

6. The solid detergent composition of claim 1 comprising between 1 wt. % to 3 wt. % of branched fatty acid active agent.

7. The solid detergent composition of claim 1, wherein the solidification agent consists of between 10 to 80 wt. % of sodium carbonate.

8. The solid detergent composition of claim 1, wherein the total composition has between 30 to 60 wt % sodium carbonate and is substantially free of sodium hydroxide.

9. The solid detergent composition of claim 1, wherein the solid detergent composition is in the form of a block having a size of at least about 5 pounds.

10. The solid detergent composition of claim 1 wherein the pH of a use solution is between about 9.5 and 11.

11. The solid detergent composition of claim 1 further comprising lipase, cutinase, peroxidase, or gluconase, or combinations thereof.

12. A method for cleaning a hard surface, comprising the steps of:

a) providing a use solution comprised of water and a detergent concentrate, the detergent concentrate comprised of a detergent composition comprising:

an alkaline source consisting of an alkali metal carbonate in an amount effective to provide a use solution having a pH of at least about 9.5;

water conditioning agent in an amount of about 1 to 50 wt. %;

water in an amount of about 1 wt. % to about 5 wt. %;

an active agent selected from the group consisting of sodium isononanoate, isononanoic acid, sodium isooctanoate, isooctanoic acid, sodium neodecanoate, neodecanoic acid, sodium neopentanoate, neopentanoic acid, sodium neoheptanoate, neoheptanoic acid, 3,5,5-trimethylhexanoic acid, 6-methyl-heptanoic acid, 2,2-dimethyloctanoic acid, neopentanoic acid (2,2-dimethylpropanoic acid), 2,2-dimethylpentanoic acid, and salts thereof, or mixtures thereof;

b) applying the use solution to a hard surface containing fish soil; and c) rinsing the surface thereby removing the fish soil from the hard surface.

* * * * *